US010160557B2

(12) United States Patent
Metzger

(10) Patent No.: US 10,160,557 B2
(45) Date of Patent: Dec. 25, 2018

(54) ICE BAGGING SYSTEM INCLUDING AUXILIARY SOURCE OF BAGS

(71) Applicant: Reddy Ice Corporation, Dallas, TX (US)

(72) Inventor: Mark C. Metzger, Glendale, AZ (US)

(73) Assignee: REDDY ICE CORPORATION, Dallas, TX (US)

( * ) Notice: Subject to any disclaimer, the term of this patent is extended or adjusted under 35 U.S.C. 154(b) by 1169 days.

(21) Appl. No.: 13/899,859

(22) Filed: May 22, 2013

(65) Prior Publication Data

US 2013/0255194 A1 Oct. 3, 2013

Related U.S. Application Data

(63) Continuation of application No. 12/856,451, filed on Aug. 13, 2010, now Pat. No. 8,468,784.

(Continued)

(51) Int. Cl.

*B65B 43/22* (2006.01)
*B65B 63/08* (2006.01)

(Continued)

(52) U.S. Cl.

CPC ..... *B65B 1/06* (2013.01); *B65B 43/123* (2013.01); *B65B 43/267* (2013.01); *B65B 43/34* (2013.01);

(Continued)

(58) Field of Classification Search

CPC ..... B65B 43/00; B65B 43/123; B65B 43/267; B65B 51/146; B65B 61/06; B65B 43/22; B65B 1/06; B65B 43/08; B65B 43/34; B65B 63/08; B65B 9/13; B65B 9/14; B65B 9/135; B65B 11/02; B65B 11/10; B65B 59/04; B65B 5/022; B65B 43/12; B65B 43/14; F25C 5/18; F25C 5/002; F25C 2600/04; B31D 5/0043; B31D 5/0047; B31D 2205/0035; B31D 2205/0047; B65H 1/28; B65H 2801/63

(Continued)

(56) References Cited

U.S. PATENT DOCUMENTS 2,116,300 A 5/1938 Campos
2,584,726 A 2/1952 McOmber (Continued)

FOREIGN PATENT DOCUMENTS

DE 8533302 U1 * 8/1987 ..... B65B 9/135
GB 1459629 12/1976

(Continued)

OTHER PUBLICATIONS

Examination Report issued by the Canadian Intellectual Property Office regarding Canadian Patent Application No. 2,788,420, dated Jun. 14, 2016, 4 pages.

(Continued)

*Primary Examiner* — Thanh Truong
*Assistant Examiner* — Thomas Wittenschlaeger
(74) *Attorney, Agent, or Firm* — Haynes and Boone, LLP

(57) ABSTRACT

An ice bagging system and method according to which ice is automatically disposed in respective bags provided from a first source of bags, and ice is automatically disposed in respective bags provided from a second source of bags.

17 Claims, 16 Drawing Sheets

Related U.S. Application Data

(60) Provisional application No. 61/300,612, filed on Feb. 2, 2010.

(51) Int. Cl.

| | |
|---|---|
| ***B65B 1/06*** | (2006.01) |
| ***B65B 43/12*** | (2006.01) |
| ***B65B 43/26*** | (2006.01) |
| ***B65B 43/34*** | (2006.01) |
| ***B65B 51/14*** | (2006.01) |
| ***B65B 61/06*** | (2006.01) |
| ***F25C 5/18*** | (2018.01) |
| ***F25C 5/20*** | (2018.01) |

(52) U.S. Cl.
CPC ..... *B65B 51/146* (2013.01); *B65B 61/06* (2013.01); *B65B 63/08* (2013.01); *F25C 5/18* (2013.01); *F25C 5/20* (2018.01)

(58) Field of Classification Search
USPC ..... 53/168, 570, 571; 493/196, 197
See application file for complete search history.

(56) References Cited

U.S. PATENT DOCUMENTS 3,498,020 A 3/1970 Eppenberger
3,503,175 A 3/1970 Marasso et al.
3,559,424 A 2/1971 Nelson
3,610,482 A 10/1971 Van Steenburgh, Jr.
3,712,019 A 1/1973 Lamka et al.
3,719,307 A 3/1973 Larson
3,789,570 A 2/1974 Mullins, Jr.
3,807,193 A 4/1974 McKenney et al.
3,822,866 A 7/1974 Daester
3,897,676 A 8/1975 Membrino
3,913,343 A 10/1975 Rowland et al.
3,918,266 A 11/1975 Gindy et al.
3,969,909 A 7/1976 Barto et al.
3,974,625 A 8/1976 Simmons
3,977,851 A 8/1976 Toya
3,982,377 A 9/1976 Vanderpool
4,013,199 A 3/1977 Brown
4,074,507 A 2/1978 Ruf
4,132,049 A 1/1979 Mullins, Jr.
4,139,029 A 2/1979 Geraci
4,139,126 A 2/1979 Krasner
4,189,063 A 2/1980 Matthiesen
4,348,872 A 9/1982 Hill
4,350,004 A 9/1982 Tsujimoto et al.
4,368,608 A 1/1983 Ray
4,404,817 A 9/1983 Cox, III
4,409,763 A 10/1983 Rydeen
4,420,197 A 12/1983 Dreiling
4,461,520 A 7/1984 Alneng
4,612,779 A 9/1986 Hatton
4,689,937 A 9/1987 Finan, Sr. et al.
4,710,157 A 12/1987 Posey
4,718,215 A 1/1988 Carveth et al.
4,903,494 A 2/1990 Wigley
4,909,696 A 3/1990 Wigley
4,942,983 A 7/1990 Bradbury
5,027,610 A 7/1991 Hara
5,079,897 A 1/1992 Muller
5,088,300 A 2/1992 Wess
5,108,590 A 4/1992 DiSanto
5,109,651 A 5/1992 Stuart
5,112,477 A 5/1992 Hamlin
5,211,030 A 5/1993 Jameson
5,277,016 A 1/1994 Williams et al.
RE34,533 E 2/1994 Wigley
5,440,863 A 8/1995 Toya et al.
5,442,898 A 8/1995 Gabree et al.
5,458,851 A 10/1995 Schroeder et al.
5,473,865 A 12/1995 Tanaka et al.
5,484,209 A 1/1996 Weng
5,489,769 A 2/1996 Kubo
D372,036 S 7/1996 Timura et al.
5,555,743 A 9/1996 Hatanaka
5,577,821 A 11/1996 Chu
5,581,982 A 12/1996 Schroeder et al.
5,630,310 A 5/1997 Chadwell
D379,880 S 6/1997 Stoeckli et al.
5,660,506 A 8/1997 Berge et al.
5,708,223 A 1/1998 Wyss
5,722,750 A 3/1998 Chu
5,761,888 A 6/1998 Haley
5,813,196 A 9/1998 Page et al.
5,822,955 A 10/1998 Woosley et al.
D407,092 S 3/1999 Weaver
5,887,442 A 3/1999 Howard et al.
5,887,758 A 3/1999 Hawkes et al.
6,044,658 A 4/2000 Ryu
6,067,658 A 5/2000 Cho
6,067,806 A 5/2000 Park
6,082,350 A 7/2000 Crews et al.
6,093,312 A 7/2000 Boulter
6,112,539 A 9/2000 Colberg
6,112,548 A 9/2000 Moenickheim
6,112,558 A 9/2000 Wang
6,119,441 A 9/2000 Lipes et al.
6,134,907 A 10/2000 Mueller et al.
6,238,031 B1 5/2001 Weng
6,266,945 B1 7/2001 Schroeder
6,276,517 B1 8/2001 Peterson et al.
6,279,329 B1 8/2001 Berge et al.
6,338,002 B1 1/2002 Kuo
6,354,338 B1 3/2002 Takemoto
6,377,863 B1 4/2002 Koontz et al.
6,394,309 B1 5/2002 Fainberg
6,405,553 B1 6/2002 Willett
6,427,456 B2 8/2002 Niwa et al.
6,474,048 B1 * 11/2002 Metzger ..... B65B 3/08 53/493
6,474,049 B1 11/2002 Lipes et al.
6,502,416 B2 1/2003 Kawasumi et al.
6,506,428 B1 1/2003 Berge et al.
6,596,233 B2 7/2003 Berge et al.
6,606,602 B1 8/2003 Kolls
6,684,647 B2 2/2004 Petrenko
6,685,053 B2 2/2004 Hawkes et al.
6,705,107 B2 3/2004 Schlosser et al.
6,827,529 B1 12/2004 Berge et al.
6,850,996 B2 2/2005 Wagner
6,860,111 B2 3/2005 Sanuki et al.
6,862,866 B2 3/2005 Jacobsen et al.
6,904,946 B2 6/2005 James
6,932,124 B2 8/2005 Dalton et al.
6,938,428 B2 9/2005 Onishi et al.
6,953,132 B2 10/2005 McCann et al.
7,003,974 B1 2/2006 Brooks
7,013,657 B2 3/2006 Hwang et al.
7,032,401 B2 4/2006 Dresser
7,062,892 B2 6/2006 Metzger
7,096,686 B2 8/2006 Brunner et al.
7,104,291 B2 9/2006 Dalton et al.
7,137,271 B2 11/2006 Hawkes et al.
7,207,156 B2 4/2007 Metzger
7,310,957 B2 12/2007 Broadbent et al.
7,344,210 B2 3/2008 Dresser
7,421,834 B1 9/2008 Doolan
7,426,812 B2 9/2008 Metzger
7,426,945 B2 9/2008 Dalton et al.
7,594,372 B2 9/2009 Micnerski
7,681,408 B2 3/2010 Hobson et al.
7,735,527 B2 6/2010 Dunn
7,806,152 B2 10/2010 Dalton et al.
2003/0150230 A1 8/2003 Waddle et al.
2004/0123569 A1 7/2004 Jacobsen et al.
2004/0216481 A1 11/2004 James et al.
2007/0175235 A1 8/2007 Metzger
2007/0267093 A1 11/2007 Soderman
2008/0022635 A1 * 1/2008 Metzger ..... B65B 1/36 53/469

(56) References Cited

U.S. PATENT DOCUMENTS

| | | | | |
|---|---|---|---|---|
| 2008/0142398 | A1 | 6/2008 | Carrigan et al. | |
| 2008/0245438 | A1 | 10/2008 | Ladson | |
| 2008/0245439 | A1 | 10/2008 | Ladson | |
| 2008/0283145 | A1 | 11/2008 | Maxwell | |
| 2009/0023569 | A1 * | 1/2009 | Frost | B65B 43/123 493/187 |

FOREIGN PATENT DOCUMENTS

| | | | |
|---|---|---|---|
| JP | H1-33455 | 10/1989 | |
| JP | H2-41067 | 3/1990 | |
| JP | 2006-105559 | 4/2006 | |
| WO | WO 2004042294 | 5/2004 | |
| WO | WO 2007059880 A1 * | 5/2007 | B31D 5/0043 |

OTHER PUBLICATIONS

International Preliminary Report on Patentability (IPRP) in International App. No. PCT/US2010/045648, dated Aug. 7, 2012, 7 pages.
Examination Report No. 1 issued by the Australian Government regarding related Australian Patent Application No. 2010345072, dated Oct. 7, 2015, 3 pages.
Louis K. Huynh, Office Action dated Mar. 26, 2007 in U.S. Appl. No. 11/371,300, U.S. Patent Office.
Informational Disclosure Statement filed Mar. 13, 2007 by Applicant, Mark Metzger, in U.S. Appl. No. 11/371,300, U.S. Patent Office.
Louis K. Huynh, Office Action dated Feb. 12, 2007 in U.S. Appl. No. 11/371,300, U.S. Patent Office.
J. Casimer Jacyna, Final Office Action dated Jul. 18, 2007 in U.S. Appl. No. 10/701,984, U.S. Patent Office.
Derek L. Woods, Decision on Petition issued Apr. 20, 2007 in U.S. Appl. No. 10/701,984, Office of Petitions, U.S. Patent Office.
Derek L. Woods, Decision on Petition issued Nov. 8, 2006 in U.S. Appl. No. 10/701,984, Office of Petitions, U.S. Patent Office.
J. Casimer Jacyna, Notice of Abandonment dated Mar. 7, 2005 in U.S. Appl. No. 10/701,984, U.S. Patent Office.
J. Casimer Jacyna, Office Action dated Jul. 12, 2004 in U.S. Appl. No. 10/701,984, U.S. Patent Office.
Hoshizaki Brochure (No Date) (12 pages).
Louis Huynh, Office Action dated Apr. 15, 2010 in U.S. Appl. No. 11/837,320, (13 pages) U.S. Patent Office.
Jimmy Foster, Order Granting Request for Ex Parte Reexamination of U.S. Pat. No. 5,109,651 to Stuart, mailed Sep. 4, 2009, Control No. 90/010,643 (11 pages), U.S. Patent Office.
Jimmy Foster, Office Action in Ex Parte Reexamination of U.S. Pat. No. 5,109,651 to Stuart, dated Feb. 26, 2010 regarding Control No. 90/010,643 (17 pages), U.S. Patent Office.
Jimmy Foster, Office Action in Ex Parte Reexamination of U.S. Pat. No. 5,109,651 to Stuart,dated Apr. 2, 2010 regarding Control No. 90/010,643 (12 pages), U.S. Patent Office.
Jimmy Foster, Order Granting Request for Ex Parte Reexamination of U.S. Pat. No. 5,109,651 to Stuart, mailed Mar. 31, 2010, Control No. 90/010,920 (9 pages), U.S. Patent Office.
Andres Kashnikow, Decision Merging Reexamination Proceedings mailed Apr. 19, 2010 regarding Control Nos. 90/010,643 and 90/010,920 (3 pages), U.S. Patent Office.
Jimmy Foster, Notice of Intent to Issue Ex Parte Reexamination mailed Apr. 20, 2010 regarding Control Nos. 90/010,643 and 90/010,920 (10 pages), U.S. Patent Office.
Louis K. Huynh, Office Action dated Jan. 29, 2010 regarding U.S. Appl. No. 12/356,410 (6 pages), U.S. Patent Office.
Louis K. Huynh, Notice of Allowance dated Jun. 1, 2010 regarding U.S. Appl. No. 12/356,410 (6 pages), U.S. Patent Office.
International Search Report in International Application No. PCT/US2010/045648, dated Oct. 5, 2010, 2 pages.
Written Opinion of the International Searching Authority in International Application No. PCT/US2010/045648, dated Oct. 5, 2010, 6 pages.
U.S. Appl. No. 60/837,374, filed Aug. 11, 2006, Metzger.
U.S. Appl. No. 60/941,191, filed May 31, 2007, Metzger.
IP Australia, Notice of Acceptance in Australian Patent Application No. 2010345072, dated Mar. 29, 2016, 2 pages.
Examination Report issued by the Canadian Intellectual Property Office regarding Canadian Patent Application No. 2,788,420, dated Oct. 12, 2016, 4 pages.
Examination Report issued by the Canadian Intellectual Property Office regarding Canadian Patent Application No. 2,788,420, dated May 17, 2017, 4 pages.

* cited by examiner

ICE BAGGING SYSTEM INCLUDING AUXILIARY SOURCE OF BAGS

CROSS-REFERENCE TO RELATED APPLICATIONS

This application is a continuation of U.S. patent application Ser. No. 12/856,451, filed Aug. 13, 2010, which claims the benefit of the filing date of U.S. patent application No. 61/300,612, filed Feb. 2, 2010, the entire disclosures of which are incorporated herein by reference.

This application is related to (1) U.S. patent application Ser. No. 10/701,984, filed Nov. 6, 2003; (2) U.S. patent application No. 60/647,221, filed Jan. 26, 2005; (3) U.S. patent application No. 60/659,600, filed Mar. 7, 2005; (4) U.S. patent application Ser. No. 11/371,300, filed Mar. 9, 2006, now U.S. Pat. No. 7,426,812; (5) U.S. patent application No. 60/837,374, filed Aug. 11, 2006; (6) U.S. patent application No. 60/941,191, filed May 31, 2007; (7) U.S. patent application Ser. No. 11/837,320, filed Aug. 10, 2007; (8) U.S. patent application Ser. No. 11/931,324, filed Oct. 31, 2007, now U.S. Pat. No. 7,497,062; (9) U.S. patent application Ser. No. 12/130,946, filed May 30, 2008; (10) U.S. patent application Ser. No. 12/356,410, filed Jan. 20, 2009; and (11) U.S. patent application No. 61/300,612, filed Feb. 2, 2010, the entire disclosures of which are incorporated herein by reference.

BACKGROUND

The present disclosure relates in general to ice and in particular to a system for bagging ice, the ice bagging system including primary and auxiliary sources of bags.

DETAILED DESCRIPTION

Figure 1:
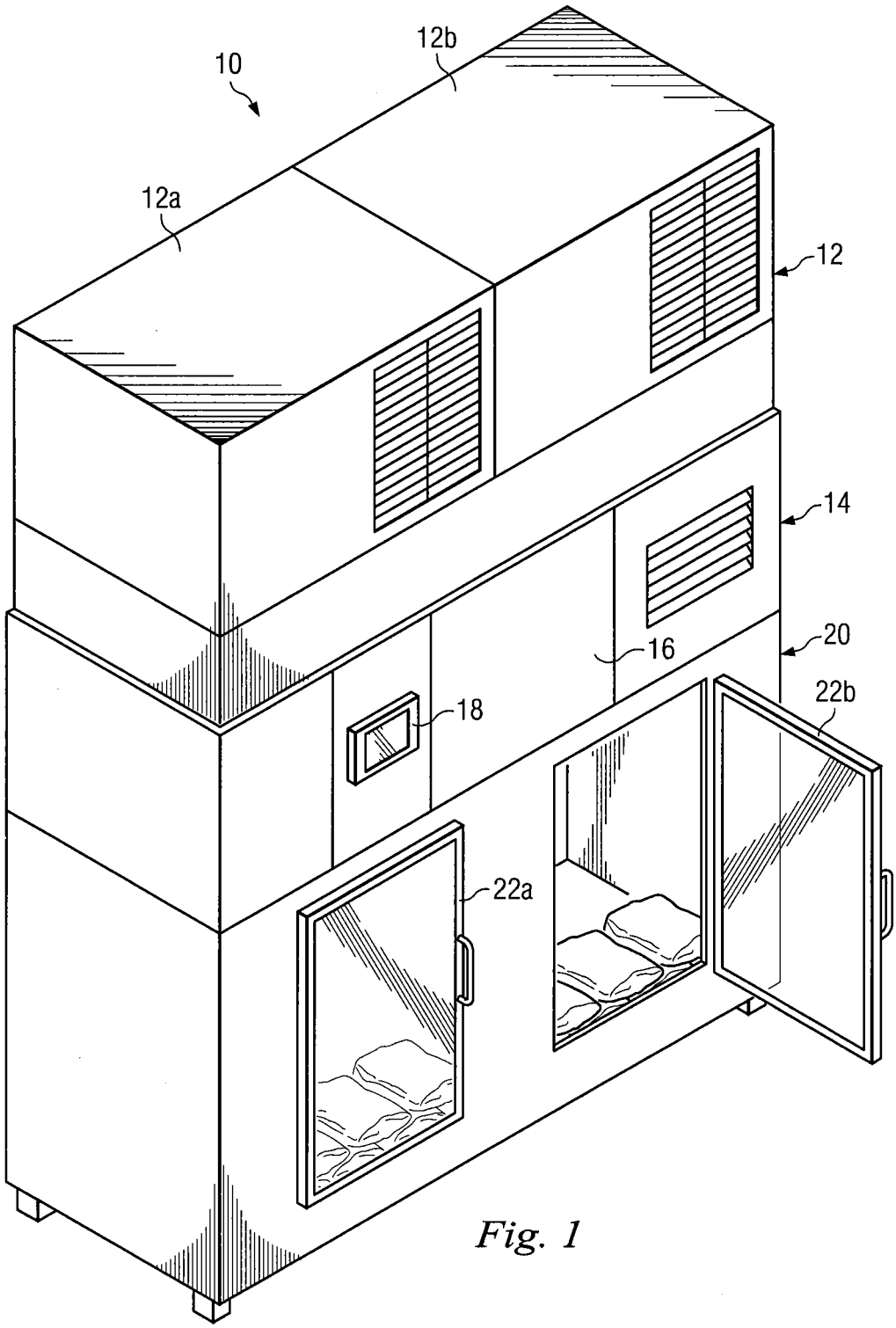
FIG. 1 is a perspective view of an ice bagging apparatus, according to an exemplary embodiment.

In an exemplary embodiment, as illustrated in FIG. 1, an ice bagging apparatus is generally referred to by the reference numeral 10 and includes ice makers 12*a* and 12*b*, which are positioned above an enclosure 14 having a panel 16. A control panel 18 is coupled to the enclosure 14. A merchandiser 20 is positioned below the enclosure 14, and is adapted to store ice-filled bags in a temperature-controlled environment, under conditions to be described below. The merchandiser 20 includes doors 22*a* and 22*b*, which permit access to the ice-filled bags that are stored in the merchandiser 20. In several exemplary embodiments, the merchandiser 20 is, includes, or is part of, any type of freezer or other temperature-controlled storage unit. In an exemplary embodiment, each of the ice makers 12*a* and 12*b* is a stackable ice cuber available from Hoshizaki America, Inc. In several exemplary embodiments, the ice bagging apparatus 10 is an in-store automated ice bagging apparatus, which is installed at a retail or other desired location, and is configured to automatically manufacture ice, automatically bag the manufactured ice (i.e., package the manufactured ice in bags), and store the bagged (or packaged) ice at the installation location.

Figure 2:
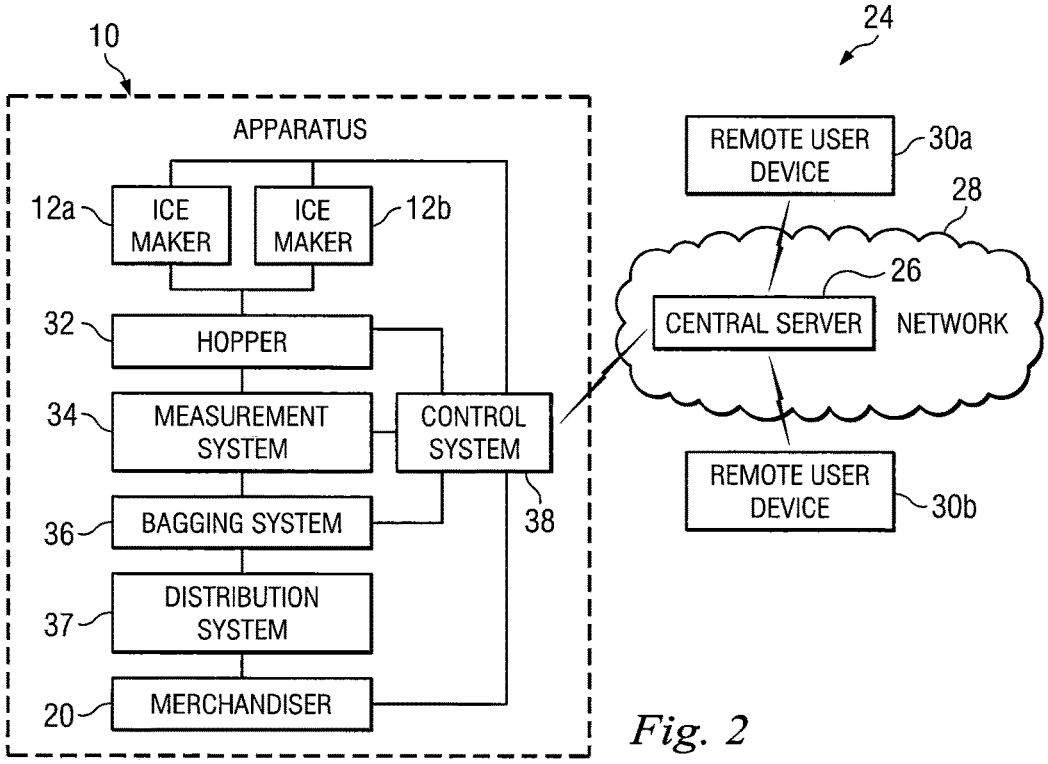
FIG. 2 is a diagrammatic illustration of a system according to an exemplary embodiment, the system including the ice bagging apparatus of FIG. 1, a central sever and a plurality of remote user devices, the ice bagging apparatus of FIG. 1 including ice makers, a hopper, a measurement system, a bagging system, a distribution system, a merchandiser, and an automatic control system.

In an exemplary embodiment, as illustrated in FIG. 2 with continuing reference to FIG. 1, a system is generally referred to by the reference numeral 24 and includes the ice bagging apparatus 10 and a central server 26, which is operably coupled to the ice bagging apparatus 10 via a network 28. Remote user devices 30*a* and 30*b* are operably coupled to, and are adapted to be in communication with, the central server 26 via the network 28. In several exemplary embodiments, the network 28 includes the Internet, any type of local area network, any type of wide area network, any type of wireless network and/or any combination thereof. In several exemplary embodiments, each of the remote user devices 30*a* and 30*b* includes a personal computer, a personal digital assistant, a cellular telephone, a smartphone, other types of computing devices and/or any combination thereof. In several exemplary embodiments, the central server 26 includes a processor and a computer readable medium or memory operably coupled thereto for storing instructions accessible to, and executable by, the processor.

As shown in FIG. 2, the ice bagging apparatus 10 further includes a hopper 32, which is operably coupled to each of the ice makers 12*a* and 12*b*. A measurement system 34 is operably coupled to the hopper 32, and a bagging system 36 is operably coupled to the measurement system 34. A distribution system 37 is operably coupled to the bagging system 36. The merchandiser 20 is operable coupled to the distribution system 37. An automatic control system 38 is operably coupled to the ice makers 12*a* and 12*b*, the hopper 32, the measurement system 34, the bagging system 36, the distribution system 37, and the merchandiser 20.

In an exemplary embodiment, the measurement system 34 is configured to receive ice from the hopper 32, and deliver measured amounts of ice to the bagging system 36. In an exemplary embodiment, the measurement system 34 defines a volume into which an amount of ice is received from the hopper 32, thereby volumetrically measuring the amount of ice. The measurement system 34 then delivers the volumetrically measured amount of ice to the bagging system 36. In an exemplary embodiment, the measurement system 34 is, or at least includes in whole or in part, one or more of the embodiments of measurement systems disclosed in U.S. patent application Ser. No. 10/701,984, filed Nov. 6, 2003, the entire disclosure of which is incorporated herein by reference. In an exemplary embodiment, the measurement system 34 is, or at least includes in whole or in part, one or more of the embodiments of measurement systems disclosed in U.S. patent application Ser. No. 11/371,300, filed Mar. 9, 2006, now U.S. Pat. No. 7,426,812, the entire disclosure of which is incorporated herein by reference, such as, for example, the drawer section disclosed in U.S. patent application Ser. No. 11/371,300. In an exemplary embodiment, the measurement system 34 is, or at least includes in whole or in part, one or more of the embodiments of measurement systems disclosed in U.S. patent application Ser. No. 11/837,320, filed Aug. 10, 2007, the entire disclosure of which is incorporated herein by reference, such as, for example, the compartment assembly disclosed in U.S. patent application Ser. No. 11/837,320. In an exemplary embodiment, the measurement system 34 is, or at least includes in whole or in part, one or more of the embodiments of measurement systems disclosed in the following U.S. patent applications: U.S. patent application No. 60/659,600, filed Mar. 7, 2005; U.S. patent application No. 60/837,374, filed Aug. 11, 2006; U.S. patent application No. 60/941,191, filed May 31, 2007; and U.S. patent application Ser. No. 11/931,324, filed Oct. 31, 2007, now U.S. Pat. No. 7,497,062, the entire disclosures of which are incorporated herein by reference.

In an exemplary embodiment, the distribution system 37 is configured to distribute ice-filled bags within the merchandiser 20. In an exemplary embodiment, the distribution system 37 includes one or more tracks (not shown) disposed within the merchandiser 20, and one or more sensors. The distribution system 37 is configured to search for available spaces within the merchandiser 20 in which to dispose ice-filled bags, and to dispose the ice-filled bags in the available spaces. In an exemplary embodiment, the distribution system is, or at least includes in whole or in part, one or more of the embodiments disclosed in U.S. patent application Ser. No. 12/130,946, filed May 30, 2008; and U.S. patent application No. 61/300,612, filed Feb. 2, 2010, the entire disclosures of which are incorporated herein by reference.

Figure 3:
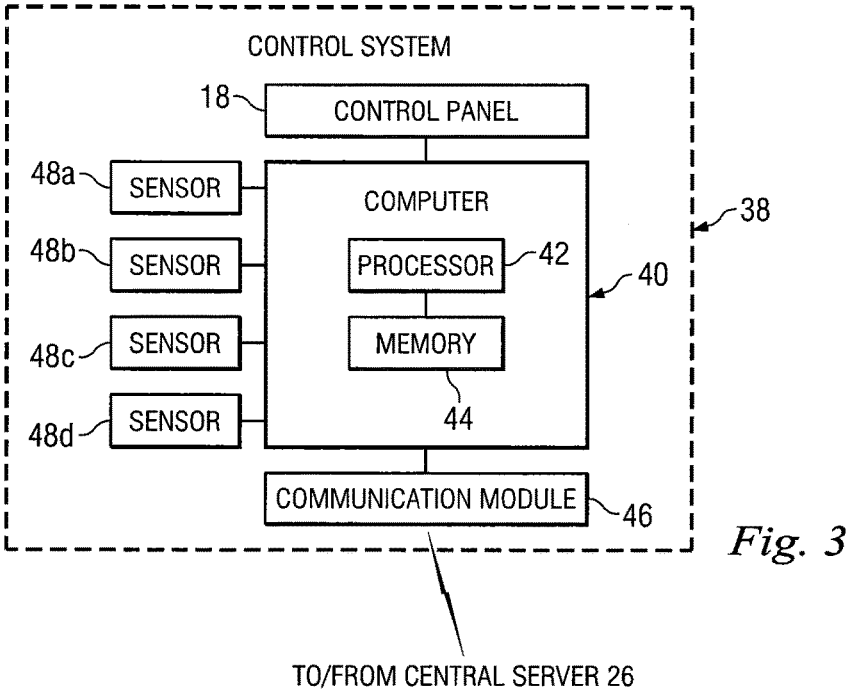
FIG. 3 is a diagrammatic illustration of the control system of FIG. 2, according to an exemplary embodiment.

In an exemplary embodiment, as illustrated in FIG. 3 with continuing reference to FIGS. 1 and 2, the automatic control system 38 includes a computer 40 including a processor 42 and a computer readable medium or memory 44 operably coupled thereto. In an exemplary embodiment, instructions accessible to, and executable by, the processor 42 are stored in the memory 44. In an exemplary embodiment, the memory 44 includes one or more databases and/or one or more data structures stored therein. A communication module 46 is operably coupled to the computer 40, and is adapted to be in two-way communication with the central server 26 via the network 28. Sensors 48*a*, 48*b*, 48*c* and 48*d* are operably coupled to the computer 40. The control panel 18 is operably coupled to the computer 40.

In an exemplary embodiment, each of the sensors 48*a*, 48*b*, 48*c* and 48*d* includes one or more sensors. In an exemplary embodiment, one or more of the sensors 48*a*, 48*b*, 48*c*, and 48*d* include respective photo cells. In an exemplary embodiment, the sensors 48*a*, 48*b*, 48*c* and 48*d* are distributed throughout the apparatus 10. In an exemplary embodiment, one or more of the sensors 48*a*, 48*b*, 48*c* and 48*d*, or one or more other sensors, are positioned in and/or on, and/or are coupled to, the merchandiser 20 or the doors 22*a* and/or 22*b* thereof, and are configured to determine if the doors 22*a* and/or 22*b* are open or closed. In an exemplary embodiment, the sensors 48*a*, 48*b*, 48*c* and 48*d* are positioned in one or more different locations in one or more of the ice makers 12*a* and 12*b*, the hopper 32, the measurement system 34, the bagging system 36, the distribution system 37, the merchandiser 20, and the control system 38.

In several exemplary embodiments, the computer 40 includes, and/or functions as, a data acquisition unit that is adapted to convert, condition and/or process signals transmitted by the sensors 48*a*, 48*b*, 48*c* and 48*d*, and one or more other sensors operably coupled to the computer 40. In an exemplary embodiment, the control panel 18 is a touch screen, a multi-touch screen, and/or any combination thereof. In several exemplary embodiments, the control panel 18 includes one or more input devices such as, for example, one or more keypads, one or more voice-recognition systems, one or more touch-screen displays and/or any combination thereof. In several exemplary embodiments, the control panel 18 includes one or more output devices such as, for example, one or more displays such as, for example, one or more digital displays, one or more liquid crystal displays and/or any combination thereof, one or more printers and/or any combination thereof. In several exemplary embodiments, the control panel 18 includes one or more card readers, one or more graphical-user interfaces and/or other types of user interfaces, one or more digital ports, one or more analog ports, one or more signal ports, one or more alarms, and/or any combination thereof. In several exemplary embodiments, the computer 40 and/or the processor 42 includes, for example, one or more of the following: a programmable general purpose controller, an application specific integrated circuit (ASIC), other controller devices and/or any combination thereof.

Figure 4:
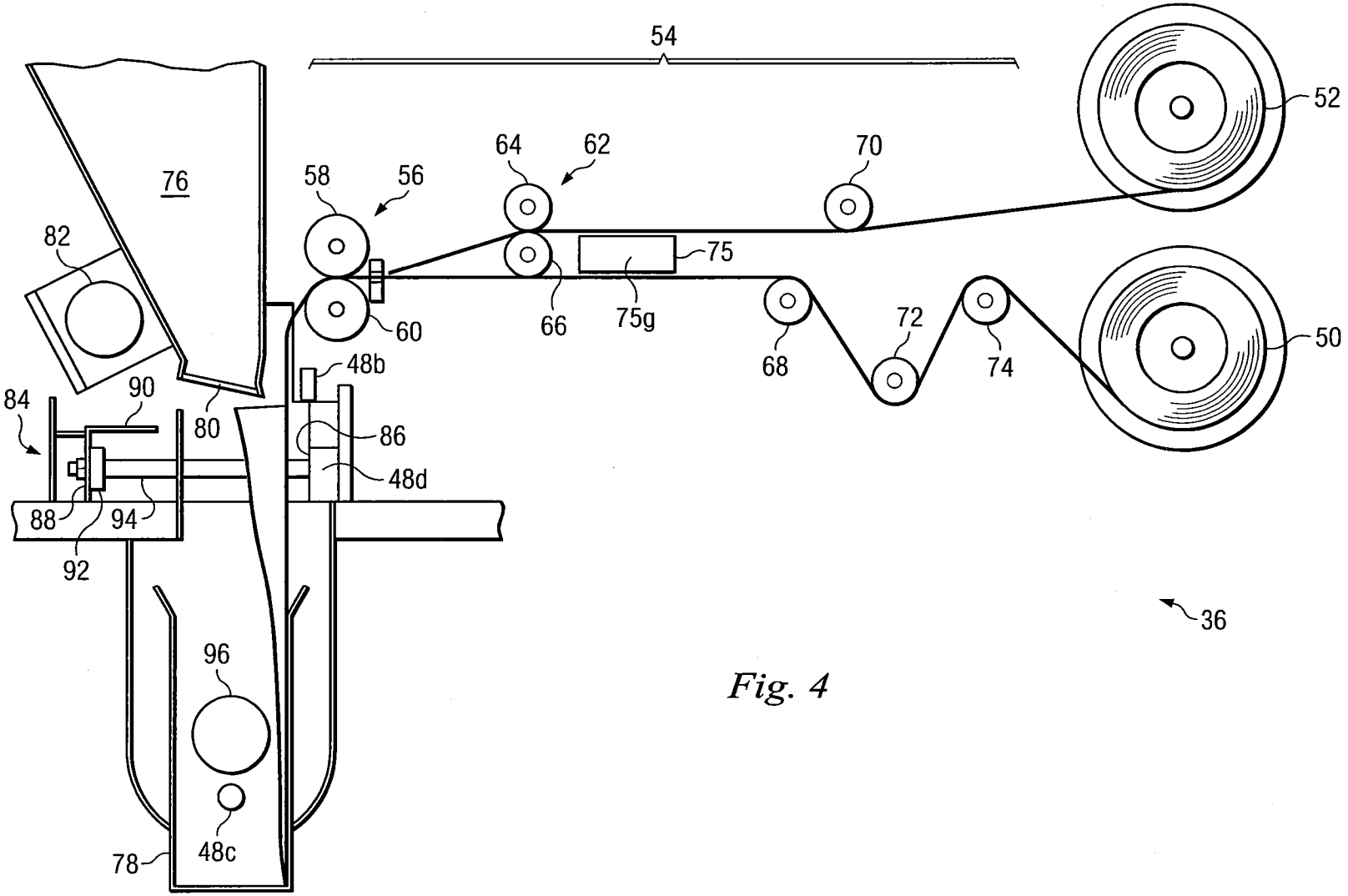
FIG. 4 is a diagrammatic illustration of a portion of the bagging system of FIG. 2, according to an exemplary embodiment.

In an exemplary embodiment, as illustrated in FIG. 4 with continuing reference to FIGS. 1-3, the bagging system 36 includes a primary source of bags 50, and an auxiliary source of bags 52. A bag feed system 54 is operably coupled to each of the sources of bags 50 and 52. The bag feed system 54 includes a main bag advance assembly 56 having an upper roller 58 and a lower roller 60, and an auxiliary bag advance assembly 62 positioned to the right of the main bag advance assembly 56 (as viewed in FIG. 4), the auxiliary bag advance assembly 62 having a top roller 64 and a bottom roller 66. Idle rollers 68, 70, 72 and 74 are positioned between the auxiliary bag advance assembly 62 and the sources 50 and 52. A support frame 75 is positioned between the auxiliary bag advance assembly 62 and the idle rollers 68, 70, 72 and 74. A chute 76 is positioned above a bag basket 78 and includes a holding plate 80 pivotally coupled to an end portion of the chute 76. A blower fan 82 is operably coupled to the chute 76, and is configured to blow air into the chute 76 under conditions to be described below. The bagging system 36 further includes a bag sealing and separation system 84, which includes a static heat seal bar 86 and a moveable arm 88, the arm 88 including a bag cutter 90 and a bumper strip 92. In an exemplary embodiment, the moveable arm 88 is operably coupled to a motor (not shown) via at least one or more rods 94. In addition to being part of the bagging system 36, the bag basket 78 is part of the distribution system 37, which further includes a rotator motor 96 operably coupled to the bag basket 78, and the sensor 48*c*, which is operably coupled to the rotator motor 96. In an exemplary embodiment, instead of, or in addition to the rollers 58 and 60, the main bag advance assembly 56 includes one or more arms configured to engage and move each of the bags from the sources 50 and/or 52. In an exemplary embodiment, instead of, or in addition to the rollers 64 and 66, the auxiliary bag advance assembly 62 includes one or more arms configured to engage and move each of the bags from the source 52.

In an exemplary embodiment, the sensor 48*b* is positioned below the main bag advance assembly 56 and slightly to the left thereof, as viewed in FIG. 4. In an exemplary embodiment, the sensor 48*b* includes a photo cell with laser, which photo cell is positioned below the main bag advance assembly 56 and slightly to the left thereof, as viewed in FIG. 4, so that the photo cell is adapted to be positioned below a bag from the source 50 or 52 that is fed by the main bag advance assembly 56 during the operation of the apparatus 10. In an exemplary embodiment, the sensor 48*b* is positioned below the chute 76 and above the bag basket 78. In an exemplary embodiment, the sensor 48*b* is positioned below the chute 76 and above the bag basket 78, and below the main bag advance assembly 56. In an exemplary embodiment, the sensor 48*d*, one or more limit switches and/or one or more micro-switches are operably coupled to both the computer 40 and the motor that is operably coupled to the moveable arm 88, and the switches are adapted to control the motor sequence of the motor.

Figure 5:
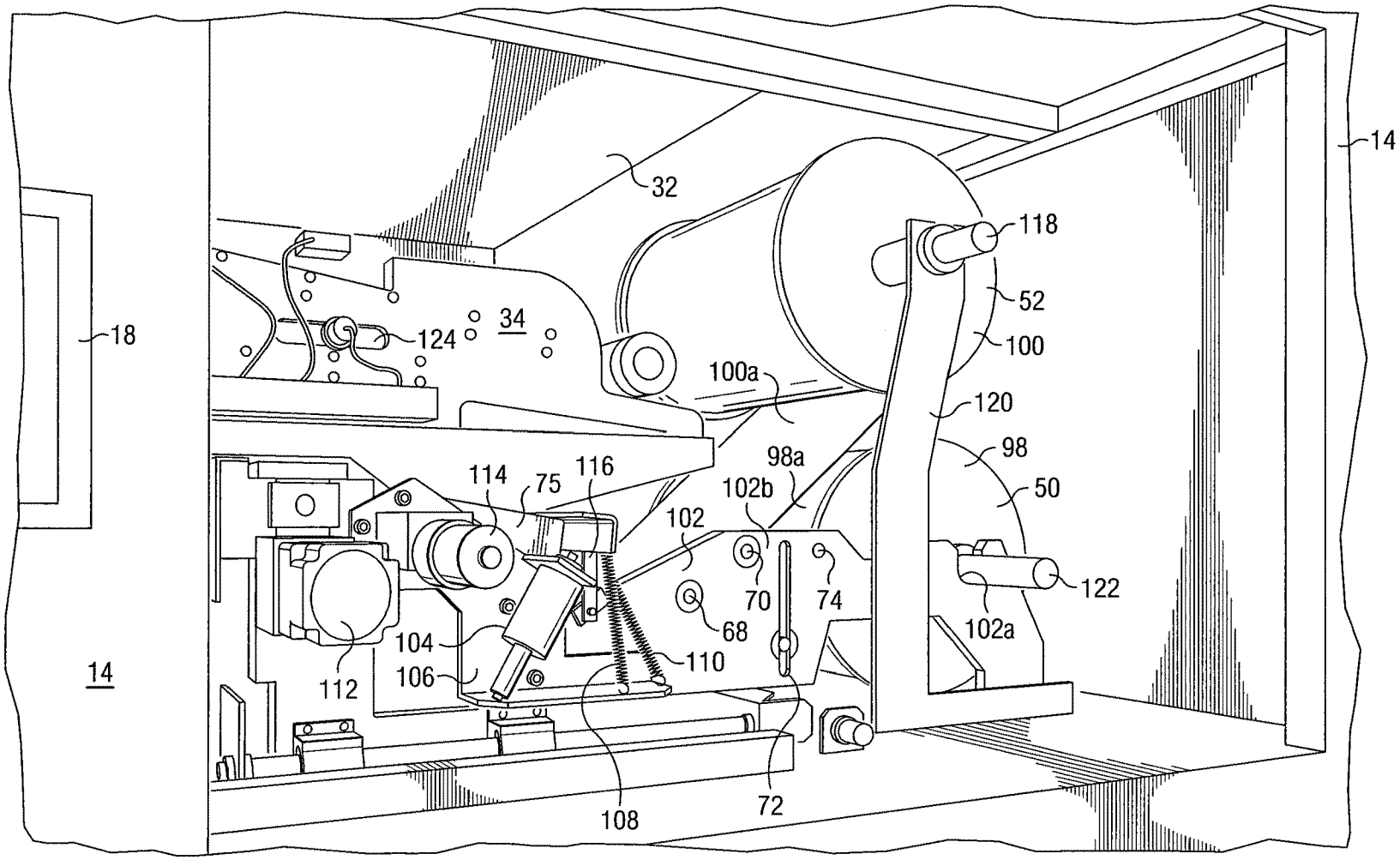
FIG. 5 is a perspective view of a portion of the ice bagging apparatus of FIGS. 1-4, according to an exemplary embodiment.

In an exemplary embodiment, as illustrated in FIG. 5 with continuing reference to FIGS. 1-4, the primary source of bags 50 is a primary roll 98 of bags 98*a*, and the auxiliary source of bags 52 is an auxiliary roll 100 of bags 100*a*. The rolls 98 and 100, the idle rollers 68, 70, 72 and 74, and the support frame 75, are positioned within the enclosure 14. The auxiliary bag advance assembly 62 and the main bag advance assembly 56 are also positioned within the enclosure 14. The bagging system 36 further includes a bag guide frame 102, a solenoid actuator 104, a solenoid support bracket 106, springs 108 and 110, a feed motor 112, a secondary motor 114, and a spring clip 116, all of which are also positioned within the enclosure 14. As shown in FIG. 5, the bagging system 36 is accessible by removing the panel 16 from the enclosure 14. In an exemplary embodiment, instead of, or in addition to the primary roll 98, the primary source 50 includes a plurality of bags hanging side by side, and/or a stack of bags. In an exemplary embodiment, instead of, or in addition to the auxiliary roll 100, the auxiliary source 52 includes a plurality of bags hanging side by side, and/or a stack of bags.

A shaft assembly 118 having a longitudinal axis is coupled to the auxiliary roll 100 of bags 100*a* so that the auxiliary roll 100 is permitted to rotate in place about the longitudinal axis of the shaft assembly 118. A roller support 120 is coupled to the enclosure 14 and the shaft assembly 118, thereby supporting the shaft assembly 118 at one end portion thereof. In an exemplary embodiment, another roller support similar to the roller support 120 may support the shaft assembly 118 at its other end portion, and/or the shaft assembly 118 may be otherwise coupled to the enclosure 14. The primary roll 98 of bags 98*a* is positioned below the auxiliary roll 100 of bags 100*a*. A shaft assembly 122 having a longitudinal axis is coupled the primary roll 98 of bags 98*a* so that the primary roll 98 is permitted to rotate in place about the longitudinal axis of the shaft assembly 122. The shaft assembly 122 is supported by the bag guide frame 102, and extends within a notch 102*a* formed in a side wall 102*b* of the bag guide frame 102.

The bags 98*a* are wound around the primary roll 98, and the bags 100*a* are wound around the auxiliary roll 100. The bags 98*a* are connected end-to-end to form a substantially continuous roll, and are pre-perforated to a predetermined measurement. Likewise, the bags 100*a* are connected end-to-end to form a substantially continuous roll, and are pre-perforated to a predetermined measurement. In an exemplary embodiment, each of the bags 98*a* and 100*a* includes digitally-coded information that is adapted to be read by one or more sensors distributed within the apparatus 10, and/or by one or more of the sensors 48*a*, 48*b*, 48*c* and 48*d*; the digitally-coded information includes, for example, bag number, bag type, bag name and/or any combination thereof. In several exemplary embodiments, each of the bags 98*a* and/or 100*a* is a single layer of material, portions of which are either initially sealed together and/or otherwise manipulated (such as two or more edges of the single layer of material being bunched together) so that the material is able to receive and hold or contain ice, or are to be sealed together and/or otherwise manipulated during the operation of the apparatus 10 so that the material is able to receive and hold or contain ice. In several exemplary embodiments, each of the bags 98*a* and/or 100*a* includes two or more layers of material, and at least respective portions of the two or more layers are either initially sealed together and/or otherwise manipulated so that the material is able to receive and hold or contain ice, or are to be sealed together and/or otherwise manipulated during the operation of the apparatus 10 so that the material is able to receive and hold or contain ice.

The idle rollers 68, 70, 72 and 74 are supported by the bag guide frame 102, and are configured to guide the bags 98*a* and/or 100*a* from each of the rolls 98 and 100 and to one or more of the main bag advance assembly 56 and the auxiliary bag advance assembly 62. The idle rollers 68, 70, 72 and 74 stretch out, and provide at least a degree of resistance to the travel of, the bags 98*a* and/or 100*a*. In an exemplary embodiment, as shown in FIGS. 4 and 5, the idle rollers 68, 72 and 74 are configured to guide the bags 98*a* from the primary roll 98, and the idle roller 70 is configured to guide the bags 100*a* from the auxiliary roll 100.

The hopper 32 and the measurement system 34 are also shown in FIG. 5. In an exemplary embodiment, as illustrated in FIG. 5, the measurement system 34 includes a drawer 124 that is configured to measure an amount of ice received from the hopper 32, and then move, relative to the hopper 32, the measured amount of ice to the chute 76. In an exemplary embodiment, instead of the drawer 124, the measurement system 34 includes moveable top and bottom doors (not shown), which define at least in part a compartment (not shown) that is configured to measure an amount of ice received from the hopper 32, and then deliver the measured amount of ice to the chute 76.

Figure 6:
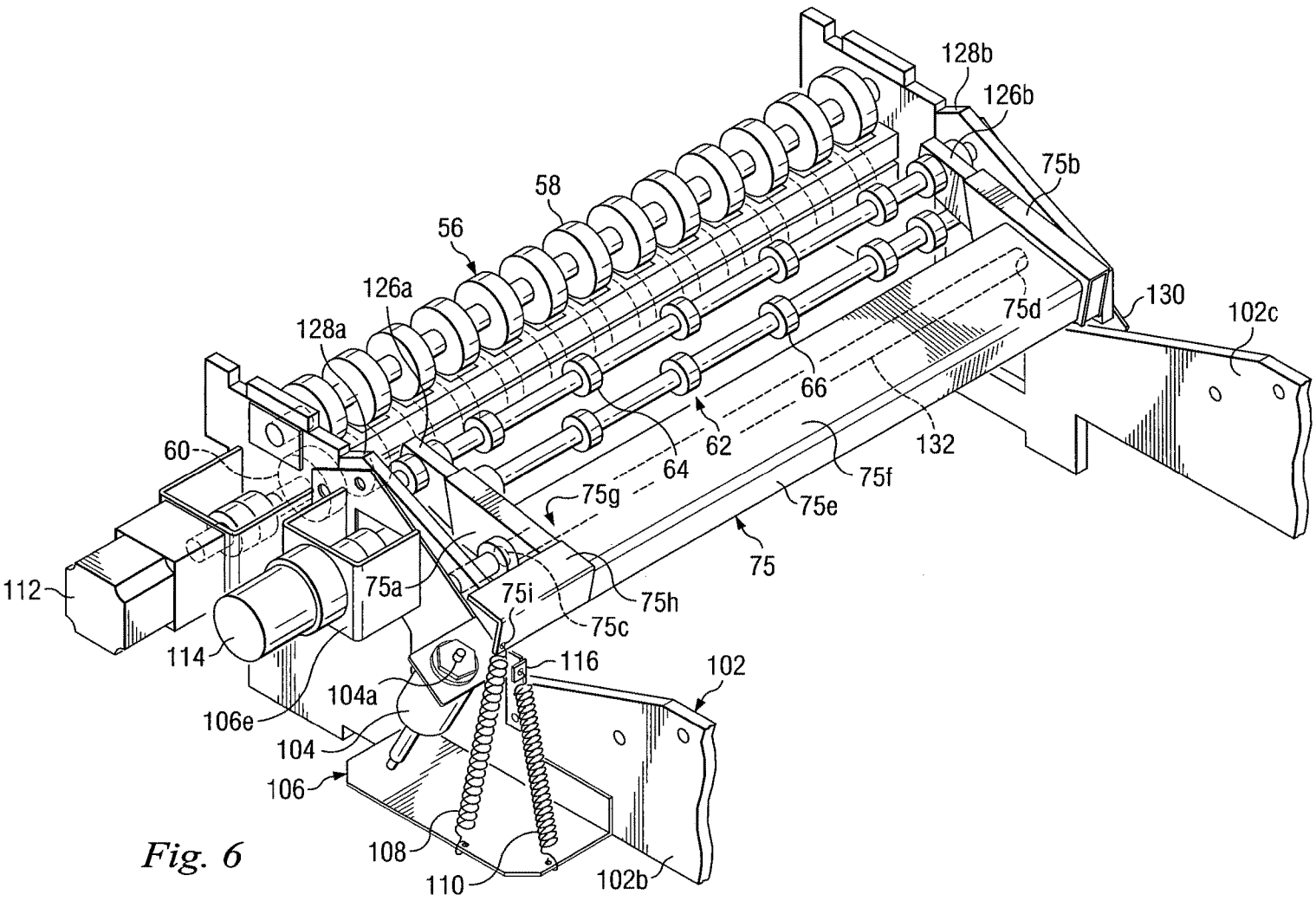
FIG. 6 is a perspective view of a portion of the bagging system of FIGS. 2, 4 and 5, according to an exemplary embodiment.
Figure 7:
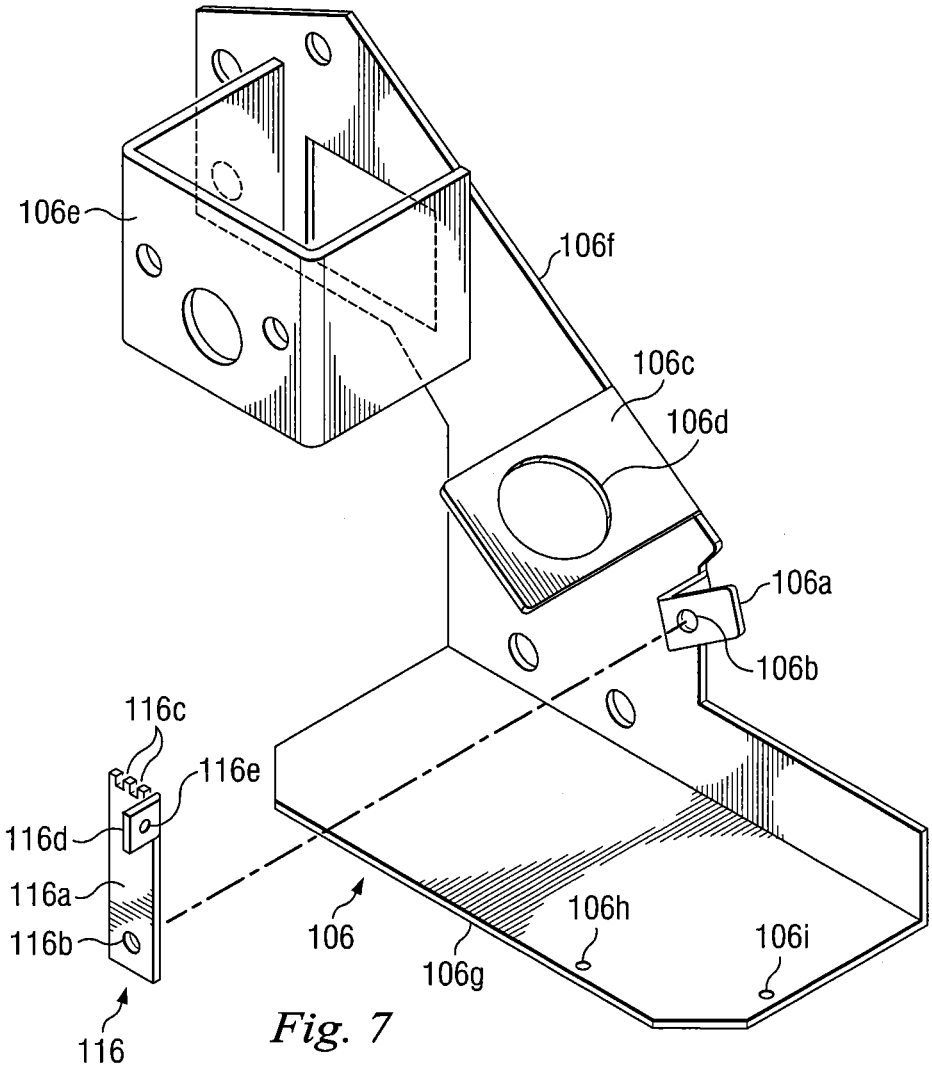
FIG. 7 is a perspective view of a portion of the portion of the bagging system of FIG. 6, according to an exemplary embodiment

In an exemplary embodiment, as illustrated in FIGS. 6 and 7 with continuing reference to FIGS. 1-5, the guide bag guide frame 102 further includes a side wall 102*c*, which is spaced in a parallel relation from the side wall 102*b*. The support frame 75 extends between the parallel-spaced side walls 102*b* and 102*c* of the bag guide frame 102. The support frame 75 includes parallel-spaced side portions 75*a* and 75*b* through which axially-aligned openings 75*c* and 75*d*, respectively, are formed. A middle portion 75*e* extends between the side portions 75*a* and 75*b*, and includes an upper wall portion 75*f* that is generally perpendicular to the side portions 75*a* and 75*b*. A region 75*g* (also shown in FIG. 4) within the middle portion 75*e* is defined at least in part by the upper wall portion 75*f* and the side portions 75*a* and 75*b*. A clip support angle 75*h* extends from an upper corner of the side portion 75*a*. An opening 75*i* is formed through the generally vertically extending wall of the clip support angle 75*h*.

Pivot arms 126*a* and 126*b* are coupled to respective inside vertically-extending surfaces of the side portions 75*a* and 75*b*. The top roller 64 extends between, and is coupled to, the pivot arms 126*a* and 126*b*. A support plate 128*a* is coupled to a vertically-extending inside surface of the solenoid support bracket 106 so that the support plate 128*a* is disposed between the solenoid support bracket 106 and the side portion 75*a* of the support frame 75. A support plate 128*b* is coupled to a vertically-extending side bracket 130, which, in turn, is coupled to the side wall 102*c* of the bag guide bar frame 102. The support plate 128*b* is disposed between the side bracket 130 and the side portion 75*b* of the support frame 75. A pivot element, such as a pivot rod 132, extends between, and is coupled to, the support plates 128*a* and 128*b*. The pivot rod 132 extends through the opening 75*c* of the support frame 75, an opening (not shown) formed through the pivot arm 126*a* that is coaxial with the opening 75*c*, the region 75*g* within the middle portion 75*e* of the support frame 75, an opening (not shown) formed through the pivot arm 126*b* that is coaxial with the opening 75*d* of the support frame 75, and the opening 75*d*. The support frame 75, the pivot arms 126*a* and 126*b*, and the top roller 64, are configured to pivot about the pivot rod 132, under conditions to be described below.

As shown in FIG. 7, the solenoid support bracket 106 includes a clip tab 106*a* through which an opening 106*b* is formed, a solenoid support tab 106*c* through which an opening 106*d* is formed, and a motor support portion 106*e*. The solenoid support bracket 106 further includes a vertically-extending portion 106*f*, from which the motor support portion 106*e* and the tabs 106*a* and 106*c* extend. The vertically-extending portion 106*f* is coupled to the side wall 102*b* of the bag guide frame 102. The vertically-extending portion 106*f* defines the vertically-extending inside surface to which the support plate 128*a* is coupled, as described above. A horizontally-extending portion 106*g* of the solenoid support bracket 106 extends from the vertically-extending portion 106*f*. Openings 106*h* and 106*i* are formed through the horizontally-extending portion 106*g*.

As shown in FIG. 6, the solenoid actuator 104 is mounted on the solenoid support bracket 106, and is coupled to the solenoid support tab 106*c* so that an actuator rod 104*a* of the solenoid actuator 104 extends angularly through the opening 106*d*. The secondary motor 114 is coupled to the motor support portion 106*e* of the solenoid support bracket 106. The secondary motor 114 is operably coupled to, and adapted to drive, the bottom roller 66 of the auxiliary bag advance assembly 62. In an exemplary embodiment, the secondary motor 114 is operably coupled to the computer 40 of the control system 38. The feed motor 112 is operably coupled to, and adapted to drive, the lower roller 60 of the main bag advance assembly 56. In an exemplary embodiment, the feed motor 112 is operably coupled to the computer 40 of the control system 38. In an exemplary embodiment, the feed motor 112 includes a stepper motor that is operably coupled to the computer 40 of the control system 38. In an exemplary embodiment, the feed motor 112 includes a programmable digital motor.

As shown in FIG. 7, the spring clip 116 includes a vertically-extending plate 116*a*, an opening 116*b* formed through the lower end portion of the plate 116*a*, a plurality of grooves (or teeth) 116*c* formed in the top edge of the plate 116*a*, and a tab 116*d* extending from the plate 116*a* and adjacent the top edge of the plate 116*a*, the tab 116*d* being generally perpendicular to the plate 116*a* and extending away from the side wall 102*b*. An opening 116*e* is formed through the tab 116*d*. The spring clip 116 is coupled to the clip tab 106*a* of the solenoid support bracket 106 via a fastener (not shown in FIG. 7) that extends through axially-aligned openings 116*b* and 106*b*. The spring clip 116 is adapted to pivot, relative to the clip tab 106*a*, about an axis that is coaxial with the axially-aligned openings 116*b* and 106*b*, under conditions to be described below. The lower edge of the clip support angle 75*h* is adapted to extend on one or more of, or within one of, the grooves in the plurality of grooves 116*c*.

As shown in FIGS. 6 and 7, the spring 108 includes an end portion that extends through the opening 106*h* of the solenoid support bracket 106, thereby coupling the spring 108 to the solenoid support bracket 106. The other end portion of the spring 108 extends through the opening 75*i* of the support frame 75, thereby coupling the spring 108 to the support frame 75. The spring 108, the opening 106*h* and the opening 75*i* are positioned and/or otherwise configured so that the spring 108 is adapted to urge or bias the lower edge of the clip support angle 75*h* into one of the grooves in the plurality of grooves 116*c*, and/or against the spring clip 116, under conditions to be described below. The spring 110 includes an end portion that extends through the opening 106*i* of the solenoid support bracket 106, thereby coupling the spring 110 to the solenoid support bracket 106. The other end portion of the spring 110 extends through the opening 116*e* of the spring clip 116, thereby coupling the spring 110 to the spring clip 116. The spring 110, the opening 106*i* and the opening 116*e* are positioned and/or otherwise configured so that the spring 110 is adapted to urge or bias the spring clip 116 to pivot, about an axis that is coaxial with the axially-aligned openings 116*b* and 106*b*, and in a clockwise direction as viewed in, for example, FIG. 4.

Figure 8:
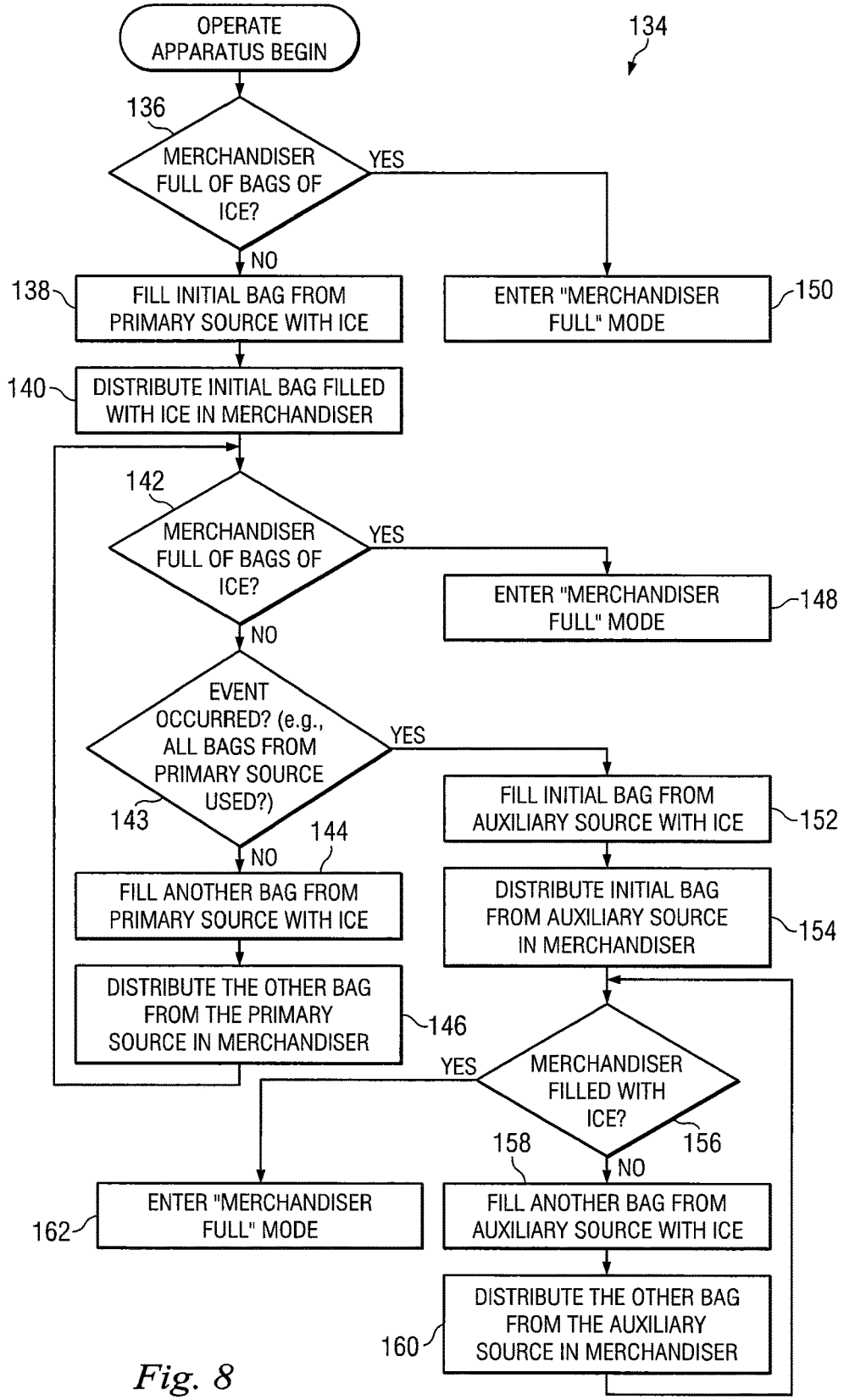
FIG. 8 is a flow chart illustration of a method of operating the ice bagging apparatus of FIGS. 1-7, according to an exemplary embodiment.

In an exemplary embodiment, as illustrated in FIG. 8 with continuing reference to FIGS. 1-7, a method 134 of operating the apparatus 10 includes determining in step 136 whether the merchandiser 20 is full of bags filled with ice. If not, then an initial bag from the primary source is automatically filled with ice in step 138, and the initial bag from the primary source is distributed in the merchandiser 20 in step 140. In step 142, it is again determined whether the merchandiser 20 is full of bags filled with ice. If not, then in step 143 it is determined whether an event has occurred, such as, for example, whether all of the bags from the primary source have been used. If the event has not occurred, then another bag from the primary source is automatically filled with ice in step 144, and the other bag from the primary source is distributed in the merchandiser 20 in step 146. The steps 142, 143, 144 and 146 are repeated until either it is determined in the step 142 that the merchandiser 20 is full of bags filled with ice, or it is determined in the step 143 that the event has occurred.

If it is determined in the step 142 that the merchandiser 20 is filled with bags of ice, then in step 148 the apparatus 10 enters a "merchandiser full" mode in which the apparatus 10 ceases automatically bagging any more ice, and/or at least ceases introducing any more ice-filled bags into the merchandiser 20. In an exemplary embodiment, a sensor (not shown) is mounted to an inside wall of the merchandiser 20, and is used to determine whether the merchandiser is filled with bags of ice. In an exemplary embodiment, during or after the step 148, the step 142, and additional steps of the method 134 that are subsequent to the step 142, are repeated when a predetermined condition is satisfied; examples of such a predetermined condition include, but are not limited to, the passage of a predetermined amount of time, the detection of the opening of the door 22*a* or 22*b* of the merchandiser 20 using the control system 38, and/or any combination thereof. Similarly, if it is determined in the step 136 that the merchandiser 20 is filled with bags of ice, then in step 150 the apparatus enters the "merchandiser full" mode. In an exemplary embodiment, during or after the step 150, the step 136, and additional steps of the method 134 that are subsequent to the step 136, are repeated when a predetermined condition is satisfied; examples of such a predetermined condition include, but are not limited to, the passage of a predetermined amount of time, the detection of the opening of the door 22*a* or 22*b* of the merchandiser 20 using the control system 38, and/or any combination thereof.

If it is determined in the step 143 that the event has occurred, then in step 152 an initial bag from the auxiliary source is automatically filled with ice in response to the determination, and the initial bag from the auxiliary source is distributed in the merchandiser 20 in step 154. In step 156, it is again determined whether the merchandiser 20 is full of bags filled with ice. If not, then another bag from the auxiliary source is filled with ice in step 158, and the other bag from the auxiliary source is distributed in the merchandiser 20 in step 160. The steps 156, 158 and 160 are repeated until it is determined in the step 156 that the merchandiser 20 is full of bags filled with ice, at which point the apparatus enters the "merchandiser full" mode in step 162. In an exemplary embodiment, during or after the step 162, the step 156, and additional steps of the method 134 that are subsequent to the step 156, are repeated when a predetermined condition is satisfied; examples of such a predetermined condition include, but are not limited to, the passage of a predetermined amount of time, the detection of the opening of the door 22*a* or 22*b* of the merchandiser 20 using the control system 38, and/or any combination thereof.

Figure 9:
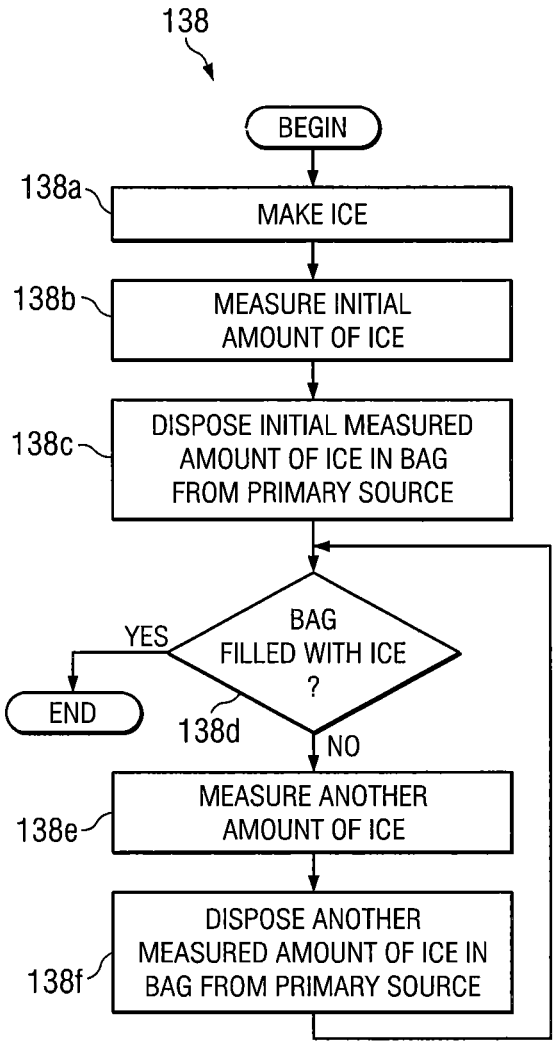
FIG. 9 is a flow chart illustration of a step of the method of FIG. 8, according to an exemplary embodiment.

In an exemplary embodiment, as illustrated in FIG. 9 with continuing reference to FIGS. 1-8, to automatically fill the initial bag from the primary source with ice in the step 138, the ice is made in step 138*a*. In an exemplary embodiment, the ice is made in the step 138*a* before, during or after one or more of the steps of the method 134. In an exemplary embodiment, the ice is made in the step 138*a* using the ice maker 12*a* and/or the ice maker 12*b*. After the ice is made in the step 138*a*, an initial amount of ice is measured in step 138*b*, and the initial measured amount of ice is automatically disposed in the initial bag from the primary source in step 138*c*. In an exemplary embodiment, the initial amount of ice is automatically measured and disposed in the bag in the steps 138*b* and 138*c* using the hopper 32, the measurement system 34, and the bagging system 36, with the hopper 32 receiving the ice from the ice maker 12*a* and/or 12*b*, the measurement system 34 automatically measuring and delivering an amount of the ice into the bag, and the bagging system 36 automatically providing the bag. After the step 138*c*, it is determined whether the bag is filled with ice in step 138*d*. If not, then another amount of ice is automatically measured in step 138*e*, and the other measured amount of ice is automatically disposed in the bag in step 138*f* using the hopper 32 and the measurement system 34. The steps 138*d*, 138*e* and 138*f* are repeated until the bag is filled with ice.

Figure 10:
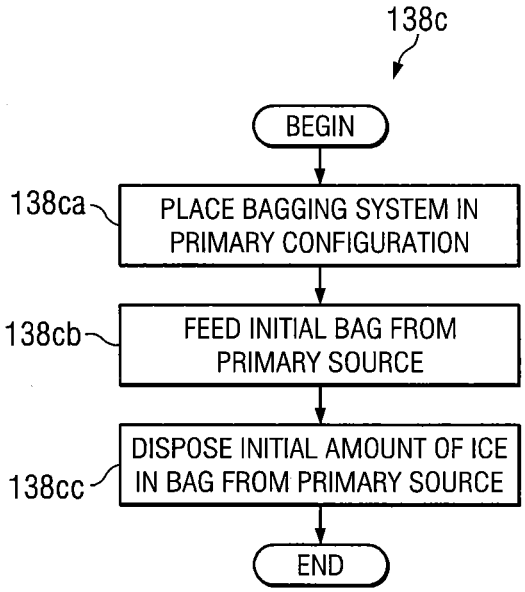
FIG. 10 is a flow chart illustration of a step of the step of FIG. 9, according to an exemplary embodiment.

In an exemplary embodiment, as illustrated in FIG. 10 with continuing reference to FIGS. 1-9, to automatically dispose the initial amount of ice in the initial bag from the primary source in the step 138*c*, the bagging system 36 is placed in its primary configuration in step 138*ca*, a bag 98*a* from the primary roll 98 of bags 98*a* is fed in step 138*cb*, and the initial amount of ice is automatically disposed in the bag 98*a* in step 138*cc*.

Figure 11A:
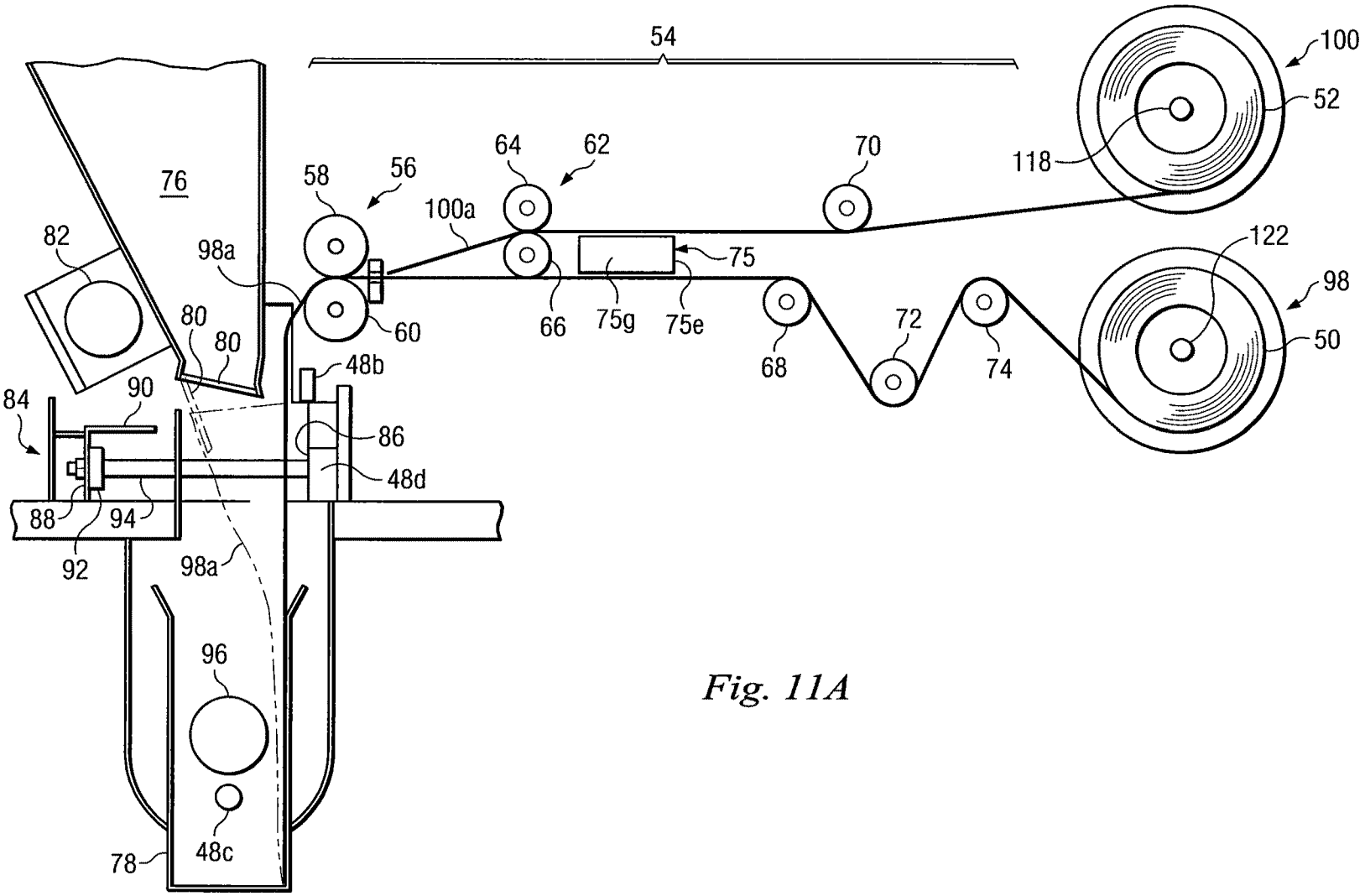
FIGS. 11A and 11B are diagrammatic illustrations of portions of the bagging system of FIGS. 2 and 4-7 during the execution of the step of FIG. X4.
Figure 11B:
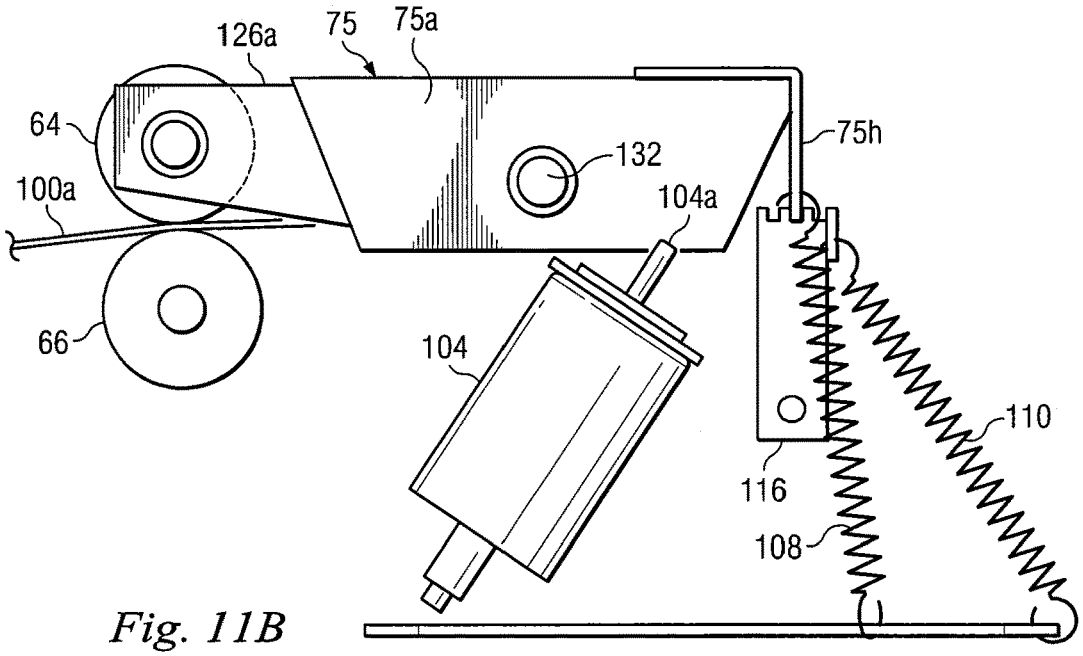

In an exemplary embodiment, as illustrated in FIGS. 11A and 11B with continuing reference to FIGS. 1-10, to place the bagging system 36 in its primary configuration in the step 138*ca*, the bags 98*a* are pulled and advanced from the primary roll 98 of bags 98, which, as necessary, rotates in place about the longitudinal axis of the shaft assembly 122. The bags 98*a* engage the idle rollers 68, 72 and 74, which stretch out, and provide at least a degree of resistance to the travel of, the bags 98*a*. The bags 98*a* extend from the idle roller 68 and past the support frame 75, extending below the middle portion 75*e* of the support frame 75. At least one of the bags 98*a* is engaged between the upper roller 58 and the lower roller 60 of the main bag advance assembly 56, thereby operably coupling the main bag advance assembly 56 to the primary roll 98 of bags 98*a*. For the purpose of clarity, this at least one of the bags 98*a* will hereinafter be referred to as "the initial primary bag 98*a*." In several exemplary embodiments, the step 138*ca* is executed before, during or after one or more of the steps 136, 150 and 138*a*.

The bags 100*a* are pulled and advanced from the auxiliary roll 100 of bags 100*a*, which, as necessary, rotates in place about the longitudinal axis of the shaft assembly 118. The bags 100*a* engage the idle roller 70, which stretches out, and provides at least a degree of resistance to the travel of, the bags 100*a*. The bags 100*a* extend from the idle roller 70 and across or above the middle portion 75*e* of the support frame 75. At least one of the bags 100*a* is engaged between the top roller 64 and the bottom roller 66 of the auxiliary bag advance assembly 62, thereby operably coupling the auxiliary bag advance assembly 62 to the auxiliary roll 100 of bags 100*a*. For the purpose of clarity, this at least one of the bags 100*a* will hereinafter be referred to as "the initial auxiliary bag 100*a*." The distal end of the initial auxiliary bag 100*a* is located either at the main bag advance assembly 56 or between the main bag advance assembly 56 and the auxiliary bag advance assembly 62. In an exemplary embodiment, one or more guide plates and/or supports (not shown) are disposed between the main bag advance assembly 56 and the auxiliary bag advance assembly 62, and are configured to guide and/or support the initial auxiliary bag 100*a* as it is fed to the main bag advance assembly 56, as will be described in further detail below. In an exemplary embodiment, the distal end of the initial auxiliary bag 100*a* is proximate the main bag advance assembly 56. In an exemplary embodiment, the auxiliary bag advance assembly 62 is proximate the main bag advance assembly 56 to such a degree (such as that shown in FIG. 6) that guide plates and/or supports are not required in order for the initial auxiliary bag 100*a* to be fed to the main bag advance assembly 56.

As shown in FIG. 11B, the solenoid actuator 104 is de-energized and the actuator rod 104*a* does not contact the clip support angle 75*h*. The spring 108 urges or biases the lower edge of the clip support angle 75*h* against the grooves 116*c* of the spring clip 116. As a result of the urging or biasing of the clip support angle 75*h* against the spring clip 116, the support frame 75 and the pivot arms 126*a* and 126*b* are positioned at a pivot location, relative to the pivot rod 132, so that the top roller 64 is urged or biased downward, thereby holding the initial auxiliary bag 100*a* in place by pinching the initial auxiliary bag 100*a* between the top roller 64 and the bottom roller 66. In other words, the spring clip 116 urges or biases the clip support angle 75*h* upwards. As a result, and since the support frame 75 is coupled to the top roller 64 via the pivot arms 126*a* and 126*b*, the top roller 64 is urged or biased downwards, thereby pinching and thus holding in place the initial auxiliary bag 100*a*, which is engaged and held between the top roller 64 and the bottom roller 66 of the auxiliary bag advance assembly 62. The grooves 116*c* facilitate the engagement between the clip support angle 75*h* and the spring clip 116, resisting relative movement therebetween.

To feed the initial primary bag 98*a* in the step 138*cb*, the feed motor 112 drives and thus rotates the lower roller 60 of the main bag advance assembly 56. As a result, the bags 98*a* are pulled and advanced from the primary roll 98, and at least respective portions of one or more of the bags 98*a* roll off of the primary roll 98, and travel through the idle rollers 68, 72 and 74, which stretch out, and provide at least a degree of resistance to the travel of, the bags 98*a*. The initial primary bag 98*a* travels between the upper roller 58 and the lower roller 60 of the main bag advance assembly 56 at least until the initial primary bag 98*a* is at least partially disposed in the bag basket 78. In an exemplary embodiment, the initial primary bag 98*a* travels about 20 inches. The position of the initial primary bag 98*a* is detected by the sensor 48*b*, and one or more signals corresponding to the position of the initial primary bag 98*a* are transmitted to the computer 40 of the control system 38 before, during and/or after the foregoing movement of the bags 98*a* within the apparatus 10. The control system 38 controls the movement of the bags 98*a* within the apparatus 10, and thus the disposal of the initial primary bag 98*a* in the bag basket 78, via at least the feed motor 112 operably coupled to the main bag advance assembly 56 and the sensor 48*b*. In an exemplary embodiment, the control system 38 controls the bagging system 36 so that the bags 98*a* are fed by a predetermined length. In an exemplary embodiment, the initial primary bag 98*a* includes a rectangular bar on the right side thereof (as viewed in FIG. 11A) and, when the sensor 48*b* reads the rectangular bar, the movement of the bags 98*a*, including the movement of the initial primary bag 98*a*, is stopped at the correct location within the apparatus 10.

As noted above, after the initial primary bag 98*a* is fed in the step 138*cb*, the initial amount of ice is automatically disposed in the initial primary bag 98*a* in the step 138*cc*. In an exemplary embodiment, the blower fan 82 blows air into the chute 76 and causes the holding plate 80 to pivot clockwise (as viewed in FIG. 11A), thereby opening, and holding open, the mouth of the initial primary bag 98*a* to facilitate the disposal of the measured amount of the ice from the measurement system 34 into the initial primary bag 98*a* via at least the chute 76.

As noted above, after the step 138*c*, it is determined whether the initial primary bag 98*a* is filled with ice in the step 138*d*. If not, then another amount of ice is measured in the step 138*e*, and disposed in the initial primary bag 98*a* in the step 138*f*, using the hopper 32 and the measurement system 34.

The steps 138*d*, 138*e* and 138*f* are repeated until the initial primary bag 98*a* is filled with ice while remaining disposed in the basket 78, after which the ice-filled initial primary bag 98*a* is distributed in the merchandiser 20 in the step 140 of the method 134. In an exemplary embodiment, the initial primary bag 98*a* is distributed in the merchandiser 20 in the step 140 using the distribution system 37, which moves the bag basket 78, and thus the ice-filled initial primary bag 98*a*, along the one or more tracks (not shown) of the distribution system 37, and/or uses one or more sensors, such as the sensor 48*c*, to search for an available space within the merchandiser 20. When such an available space is found, the rotator motor 96 is activated to cause the bag basket 78 to rotate; as a result, the ice-filled initial primary bag 98*a* falls into and is disposed in the available space in the merchandiser 20.

In an exemplary embodiment, before or during the distribution of the initial primary bag 98*a* in the merchandiser 20 in the step 140 of the method 134, the initial primary bag 98*a* is sealed and separated from the remainder (if any) of the bags 98*a* by activating the motor (not shown) that is operably coupled to the moveable arm 88 so that the one or more rods 94, and thus the moveable arm 88, the bag cutter 90 and the bumper strip 92, move towards the static heat seal bar 86. As a result, the upper portion of the initial primary bag 98*a* is pressed between the bumper strip 92 and the static heat seal bar 86, and so that the bag cutter 90 engages the initial primary bag 98*a* and/or the bag 98*a* adjacent thereto in the vicinity of the perforated line between the adjacent bags 98*a*. In response, the initial primary bag 98*a* is heat sealed and cut off and separated from the remainder of the bags 98*a*. In an exemplary embodiment, the control system 38 controls the heat sealing and separation of the initial primary bag 98*a* via the sensor 48*d*, the motor that is operably coupled to the moveable arm 88, one or more thermostats, and/or any combination thereof.

As noted above, if it is determined in the step 142 that the merchandiser 20 is not full of bags filled with ice and in the step 143 that the event has not occurred (e.g., not all of the bags 98*a* from the primary roll 98 have been used), then another bag 98*a* from the primary roll 98 is automatically filled with ice in the step 144, and is distributed in the merchandiser in the step 146. In the step 144, the other bag 98*a* is fed by the main bag advance assembly 56, traveling between the upper roller 58 and the lower roller 60 at least until the other bag 98*a* is at least partially disposed in the bag basket 78. The step 144 is substantially identical to the step 138, except that the step 138*ca* (i.e., placing the bagging system 36 in its primary configuration) is omitted because the bagging system 36 is already in its primary configuration; therefore, the step 144 will not be described in further detail. The step 146 is substantially identical to the step 140 and therefore will not be described in detail.

In an exemplary embodiment, to determine in the step 143 whether the event has occurred (for example, to determine whether all of the bags 98*a* from the roll 98 have been used), it is determined whether the sensor 48*b* is "blocked," that is, it is determined—using the sensor 48*b*—whether one of the remaining bags 98*a*, which succeeds the initial primary bag 98*a* on the roll 98, is above the sensor 48*b* after at least a portion of the initial primary bag 98*a* has been fed by the main bag advance assembly 56 and the initial primary bag 98*a* is at least partially disposed in the bag basket 78. If the sensor 48*b* is so "blocked," then it is determined in the step 143 that the event has not occurred, that is, not all of the bags 98*a* from the primary roll 98 have been used. If the sensor 48 is not so "blocked," then it is determined in the step 143 that the event has occurred, that is, all of the bags 98*a* from the primary roll 98 have been used and thus no more of the bags 98*a* are available for bagging ice. In several exemplary embodiments, instead of, or in addition to determining whether all of the bags 98*a* from the primary roll 98 have been used, it is determined in the step 143 whether a different event has occurred such as, for example, whether a predetermined number (rather than all) of the bags 98*a* from the primary roll 98 have been used, and/or whether an alarm has been triggered by the control system 38. In an exemplary embodiment, such an alarm may indicate the inability of the apparatus 10 to further automatically dispose measured amounts of ice in the respective bags 98*a* provided from the primary roll 98 due to, for example, an operational problem with the primary roll 98 and/or the feeding of the bags 98*a* therefrom, such as the jamming of the primary roll 98 and/or one or more of the bags 98*a*.

Figure 12:
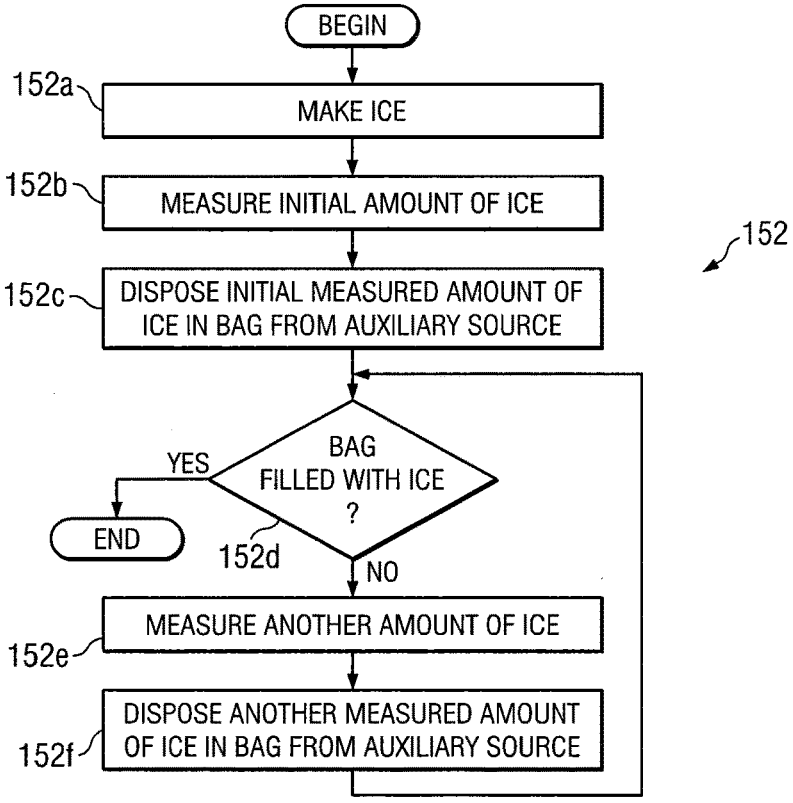
FIG. 12 is a flow chart illustration of another step of the method of FIG. 8, according to an exemplary embodiment.

In an exemplary embodiment, as illustrated in FIG. 12 with continuing reference to FIGS. 1-11B, to automatically fill the initial auxiliary bag 100*a* from the auxiliary roll 100 with ice in the step 152, the ice is made in step 152*a*. In an exemplary embodiment, the ice is made in the step 152*a* before, during or after one or more of the steps of the method 134. In an exemplary embodiment, the ice is made in the step 152*a* using the ice maker 12*a* and/or the ice maker 12*b*. After the ice is made in the step 152*a*, an initial amount of ice is measured in step 152*b*, and the initial measured amount of ice is automatically disposed in the initial auxiliary bag 100*a* from the auxiliary roll 100 in step 152*c*. In an exemplary embodiment, the initial amount of ice is automatically measured and disposed in the initial auxiliary bag 100*a* in the steps 152*b* and 152*c* using the hopper 32, the measurement system 34, and the bagging system 36, with the hopper 32 receiving the ice from the ice maker 12*a* and/or 12*b*, the measurement system 34 measuring and delivering an amount of the ice into the bag, and the bagging system 36 providing the bag. After the step 152*c*, it is determined whether the initial auxiliary bag 100*a* is filled with ice in step 152*d*. If not, then another amount of ice is measured in step 152*e*, and the other measured amount of ice is automatically disposed in the bag in step 138*f* using the hopper 32 and the measurement system 34. The steps 152*d*, 152*e* and 152*f* are repeated until the initial auxiliary bag 100*a* is filled with ice.

Figure 13:
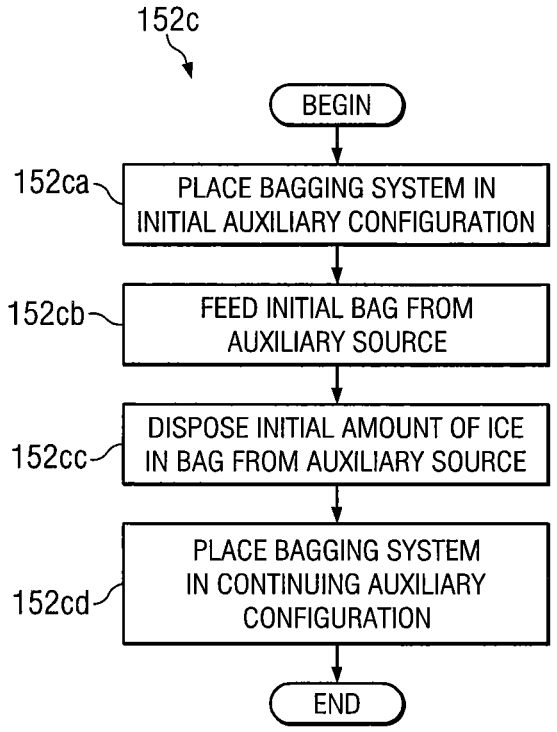
FIG. 13 is a flow chart illustration of a step of the step of FIG. 12, according to an exemplary embodiment.

In an exemplary embodiment, as illustrated in FIG. 13 with continuing reference to FIGS. 1-12, to dispose the initial amount of ice in the initial auxiliary bag 100*a* from the auxiliary roll 100 in the step 152*c*, the bagging system 36 is placed in its initial auxiliary configuration in step 152*ca*, the initial auxiliary bag 100*a* from the auxiliary roll 100 is fed in step 152*cb*, the initial amount of ice is automatically disposed in the initial auxiliary bag 100*a* in step 152*cc*, and the bagging system 36 is placed in its continuing auxiliary configuration in step 152*cd*.

Figure 14B:
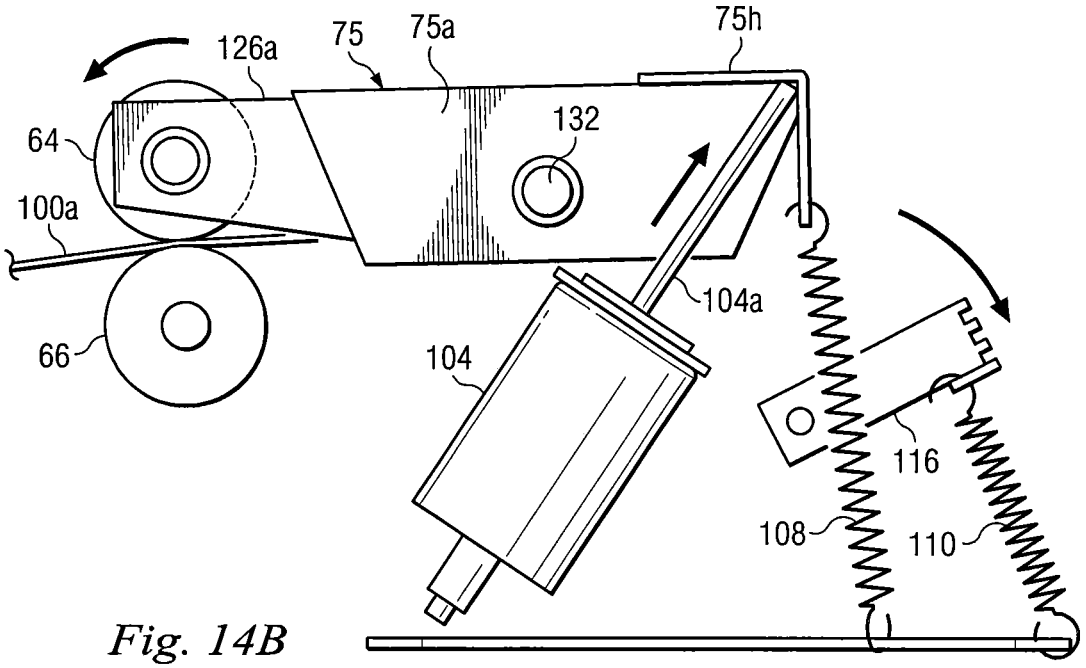
FIGS. 14A and 14B are diagrammatic illustrations of portions of the bagging system of FIGS. 2 and 4-7 during the execution of a step of the step of FIG. 13, according to an exemplary embodiment.
Figure 14A:
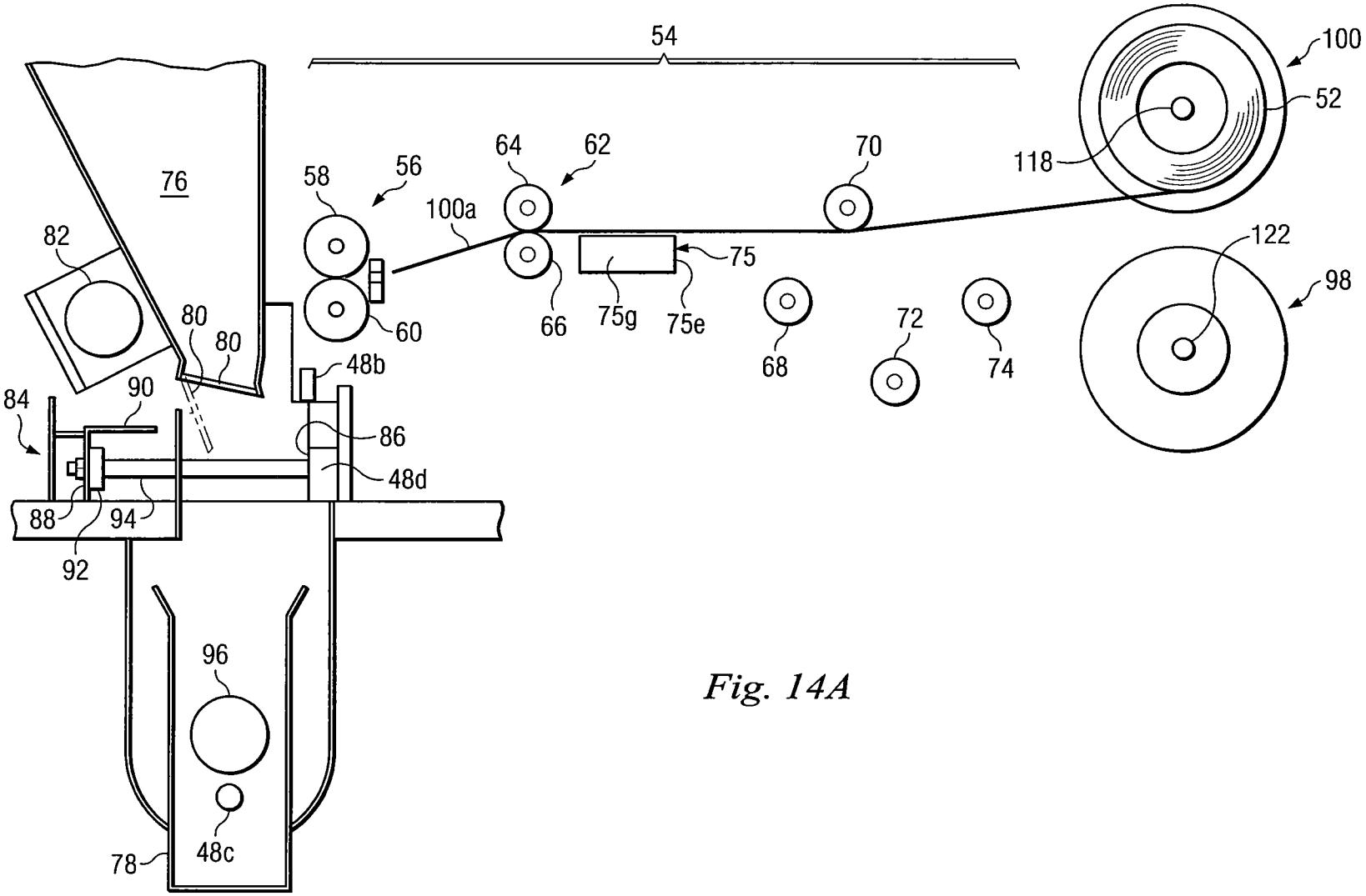

In an exemplary embodiment, as illustrated in FIGS. 14A and 14B with continuing reference to FIGS. 1-13, to place the bagging system 36 in its initial auxiliary configuration in the step 152*ca*, the solenoid actuator 104 is energized and thus the actuator rod 104*a* moves angularly upward and contacts the clip support angle 75*h*, overcoming the downward urging by the spring 108 and pushing the lower edge of the clip support angle 75*h* off of the spring clip 116. As a result, the top roller 64 is further urged or biased downwards, further pinching and thus holding in place the initial auxiliary bag 100*a*, which continues to be engaged and held between the top roller 64 and the bottom roller 66 of the auxiliary bag advance assembly 62. In an exemplary embodiment, the lower edge of the clip support angle 75*h* is only slightly raised off of the spring clip 116 in response to the energizing of the solenoid actuator 104, enough to allow the spring clip 116 to pivot in a clockwise direction as viewed in FIG. 14B, and the pivot position of the top roller 64 in the primary configuration of the bagging system 36 is either maintained in the initial auxiliary configuration of the bagging system 36, or the top roller 64 is only slightly further urged or biased downwards.

Figure 15A:
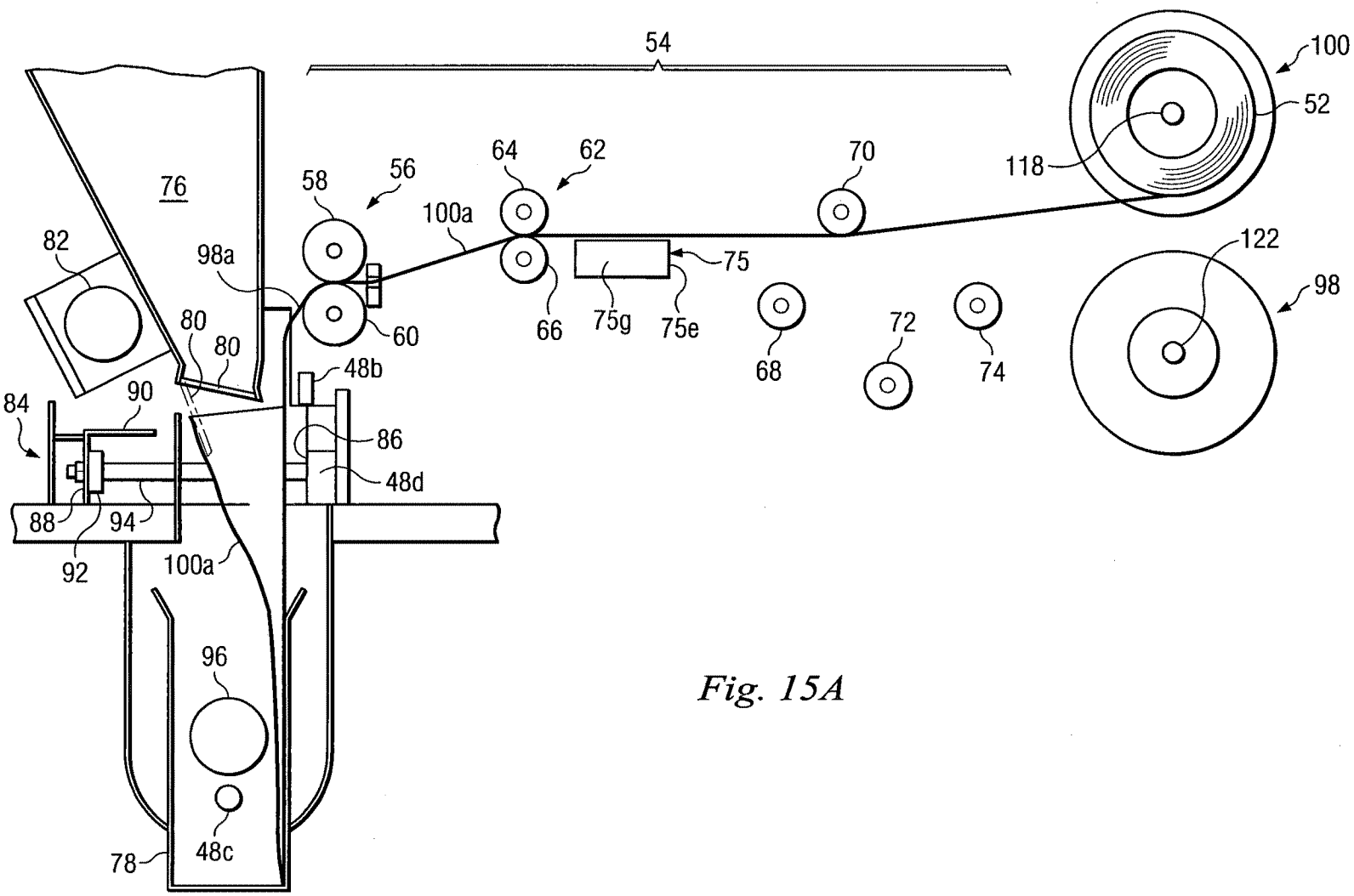
FIGS. 15A and 15B are diagrammatic illustrations of portions of the bagging system of FIGS. 2 and 4-7 during the execution of another step of the step of FIG. 13, according to an exemplary embodiment.
Figure 15B:
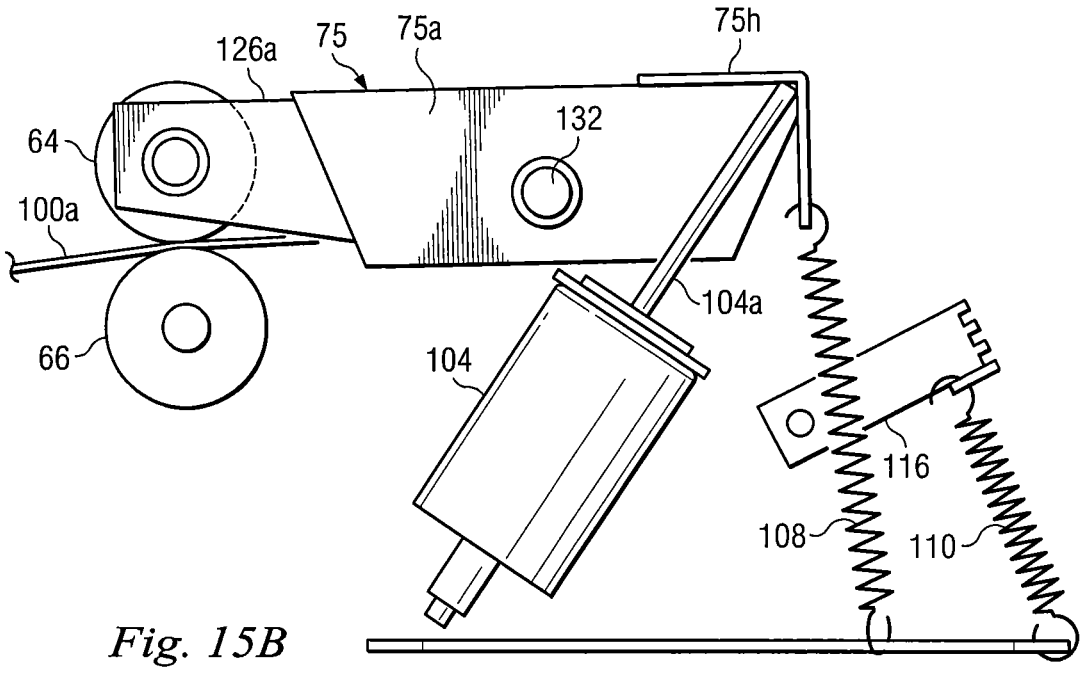

In an exemplary embodiment, as illustrated in FIGS. 15A and 15B with continuing reference to FIGS. 1-14B, to feed the initial auxiliary bag 100*a* from the auxiliary roll 100 in the step 152*cb*, the secondary motor 114 drives and thus rotates the bottom roller 66, advancing the initial auxiliary bag 100*a* to the main bag advance assembly 56, thereby operably coupling the main bag advance assembly 56 to the auxiliary roll 100 of bags 100*a* rather than to the primary roll 98. The feed motor 112 drives and rotates the lower roller 60 of the main bag advance assembly 56. As the initial auxiliary bag 100*a* is advanced between the upper roller 58 and the lower roller 60 of the main bag advance assembly 56, the rotation of the lower roller 60 further feeds the bag 100*a*, causing the bag 100*a* to travel between the rollers 58 and 60 at least until the bag 100*a* is at least partially disposed in the bag basket 78. The position of the initial auxiliary bag 100*a* is detected by the sensor 48*b*, and one or more signals corresponding to the position of the initial auxiliary bag 100*a* is transmitted to the computer 40 of the control system 38 before, during and/or after the foregoing movement of the bags 100*a* within the apparatus 10. The control system 38 controls the movement of the bags 100*a* within the apparatus 10, and thus the disposal of the initial auxiliary bag 100*a* in the bag basket 78, via at least the feed motor 112 operably coupled to the main bag advance assembly 56 and the sensor 48*b*. In an exemplary embodiment, the control system 38 controls the bagging system 36 so that the bags 100*a* are fed by a predetermined length. In an exemplary embodiment, the initial auxiliary bag 100*a* includes a rectangular bar on the right side thereof (as viewed in FIG. 15A) and, when the sensor 48*b* reads the rectangular bar, the movement of the bags 100*a*, including the movement of the initial auxiliary bag 100*a*, is stopped at the correct location within the apparatus 10.

As noted above, after the initial auxiliary bag 100*a* is fed in the step 152*cb*, the initial measured amount of ice is automatically disposed in the initial auxiliary bag 100*a* in the step 152*cc*. In an exemplary embodiment, the blower fan 82 blows air into the chute 76 and causes the holding plate 80 to pivot clockwise (as viewed in FIG. 15A), thereby opening, and holding open, the mouth of the initial auxiliary bag 100*a* to facilitate the delivery of the amount of the ice from the measurement system 34 to the initial auxiliary bag 100*a* via at least the chute 76.

Figure 16B:
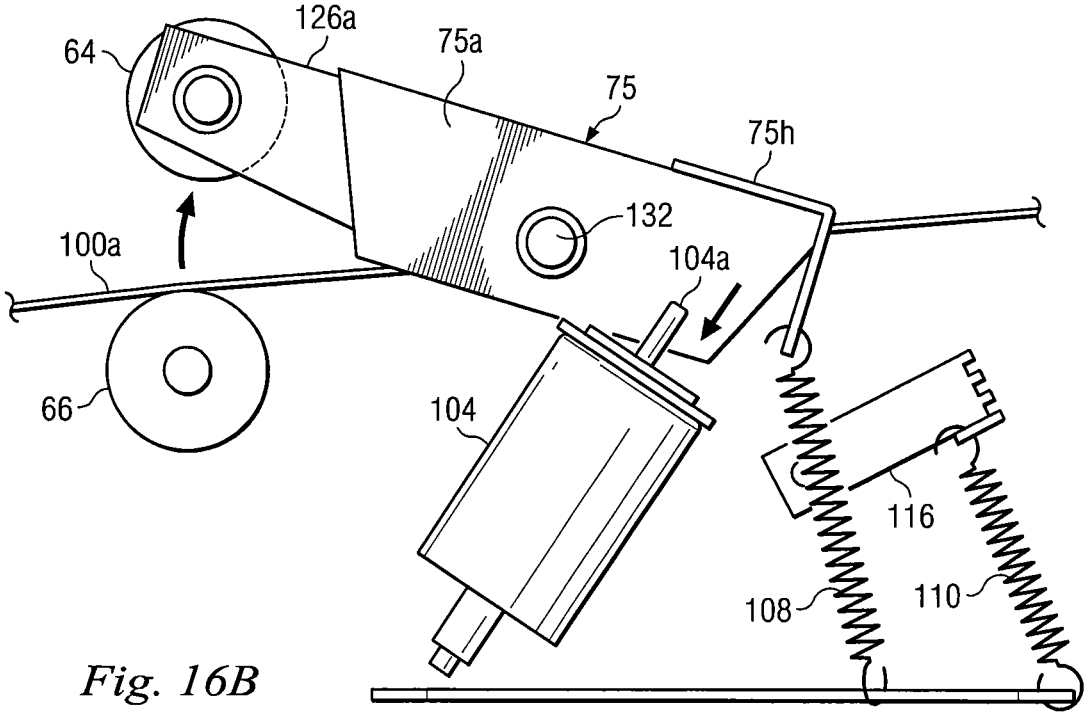
FIGS. 16A and 16B are diagrammatic illustrations of portions of the bagging system of FIGS. 2 and 4-7 during the execution of yet another step of the step of FIG. 13, according to an exemplary embodiment.
Figure 16A:
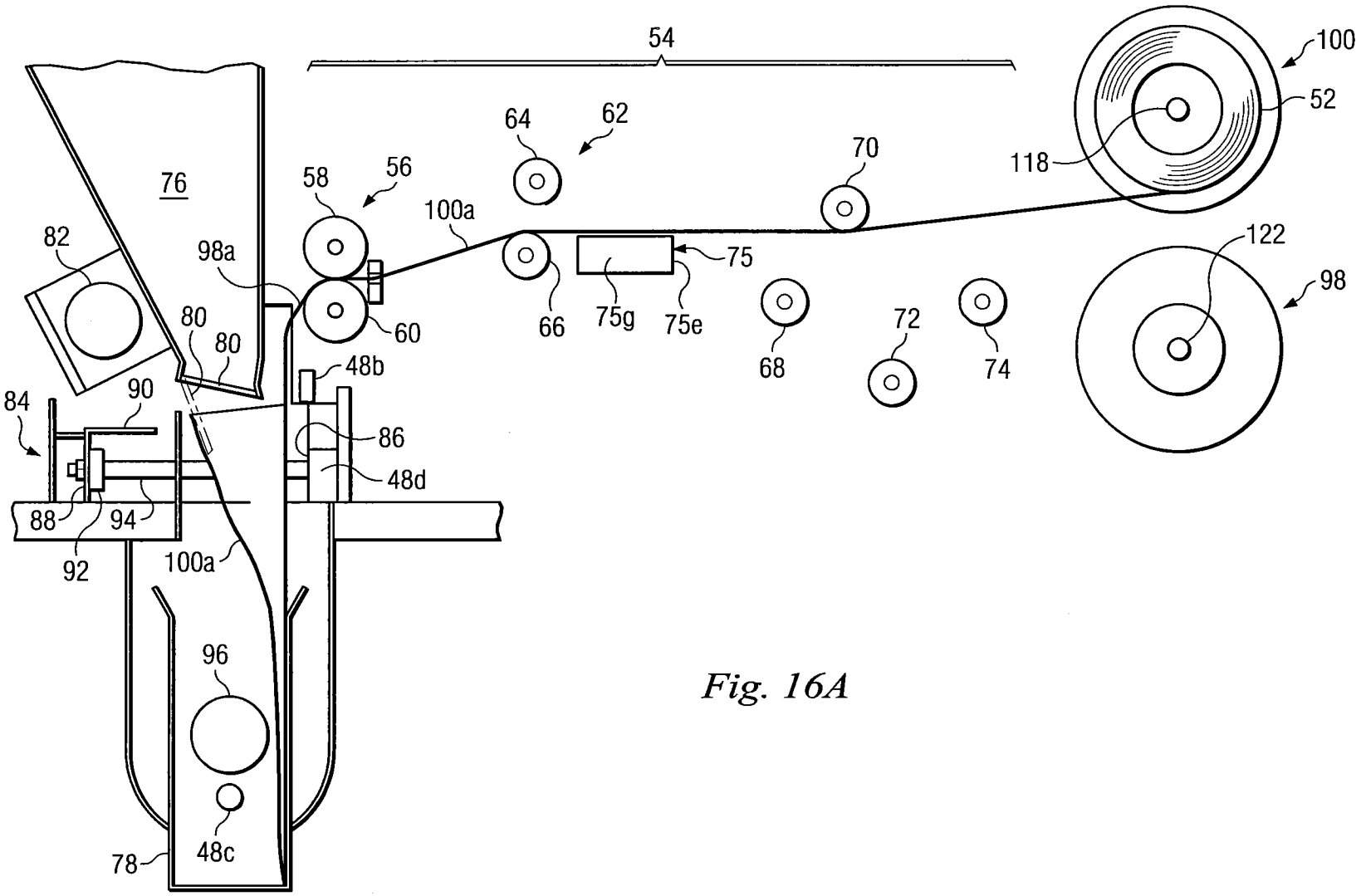

In an exemplary embodiment, as illustrated in FIGS. 16A and 16B, before, during or after the steps 152*cb* and/or 152*cc*, the bagging system 36 is placed in its continuing auxiliary configuration in step 152*cd*. To so place the bagging system 36, the solenoid actuator 104 is de-energized, causing the actuator rod 104*a* to retract, moving angularly downward so that the actuator rod 104*a* no longer contacts the clip support angle 75*h*. As a result, and since the spring clip 116 has been previously pivoted out of the way, the spring 108 urges or biases the clip support angle 75*h* downward, causing the support frame 75, the pivot arms

126*a* and 126*b*, and the top roller 64 to pivot about the pivot rod 132 in a clockwise direction, as viewed in FIG. 16B. As a result, the top roller 64 is spaced away from the bottom roller 66, disengaging from any of the bags 100*a*. Hereafter, in an exemplary embodiment, when the bagging system 36 is in its continuing auxiliary configuration, the bottom roller 66 is not driven by the secondary motor 114 and instead is either static or functions as an idle roller.

As noted above, after the step 152*c*, it is determined whether the initial auxiliary bag 100*a* is filled with ice in the step 152*d*. If not, then another amount of ice is measured in the step 152*e*, and automatically disposed in the initial auxiliary bag 100*a* in the step 152*f*, using the hopper 32 and the measurement system 34.

The steps 152*d*, 152*e* and 152*f* are repeated until the initial auxiliary bag 100*a* is filled with ice while remaining disposed in the basket 78, after which the ice-filled initial auxiliary bag 100*a* is distributed in the merchandiser 20 in the step 154 of the method 134. In an exemplary embodiment, the initial auxiliary bag 100*a* is distributed in the merchandiser 20 in the step 154 using the distribution system 37, which moves the bag basket 78, and thus the ice-filled initial auxiliary bag 100*a*, along the one or more tracks (not shown) of the distribution system 37, and/or uses one or more sensors, such as the sensor 48*c*, to search for an available space within the merchandiser 20. When such an available space is found, the rotator motor 96 is activated to cause the bag basket 78 to rotate; as a result, the ice-filled initial auxiliary bag 100*a* falls into and is disposed in the available space in the merchandiser 20.

In an exemplary embodiment, before or during the distribution of the initial auxiliary bag 100*a* in the merchandiser 20 in the step 154 of the method 134, the initial auxiliary bag 100*a* is sealed and separated from the remainder of the bags 100*a* in a manner substantially identical to the above-described manner by which the initial primary bag 98*a* is sealed and separated.

As noted above, if it is determined in the step 156 that the merchandiser 20 is not full of bags filled with ice, then another bag 100*a* from the auxiliary roll 100 is automatically filled with ice in the step 158, and is distributed in the merchandiser 20 in the step 160. In the step 158, the other bag 100*a* is fed by the main bag advance assembly 56, traveling between the upper roller 58 and the lower roller 60 at least until the other bag 100*a* is at least partially disposed in the bag basket 78. The step 158 is substantially identical to the step 152, except that the steps 152*ca* and 152*cd* (i.e., placing the bagging system in its initial auxiliary configuration and its continuing auxiliary configuration, respectively) are omitted because the bagging system 36 is already in its continuing auxiliary configuration; therefore, the step 158 will not be described in further detail. The step 160 is substantially identical to the steps 140 and 146 and therefore will not be described in detail.

If it is determined in the step 156 that the merchandiser 20 is filled with bags of ice, then in step 162 the apparatus 10 enters the "merchandiser full" mode. In an exemplary embodiment, during or after the step 162, the step 156, and additional steps of the method 134 that are subsequent to the step 156, are repeated when a predetermined condition is satisfied; examples of such a predetermined condition include, but are not limited to, the passage of a predetermined amount of time, the detection of the opening of the door 22*a* or 22*b* of the merchandiser 20 using the control system 38, and/or any combination thereof.

In an exemplary embodiment, at least one other apparatus substantially similar to the apparatus 10 and located at the same or another location may be operably coupled to the server 26 via the network 28. In an exemplary embodiment, a plurality of apparatuses substantially similar to the apparatus 10 and located at the same and/or different locations may be operably coupled to the server 26 via the network 28. In several exemplary embodiments, the computer readable medium of the server 26, and the contents stored therein, may be distributed throughout the system 24. In an exemplary embodiment, the computer readable medium of the server 26 and the contents stored therein may be distributed across a plurality of apparatuses such as, for example, the apparatus 10 and/or one or more other apparatuses substantially similar to the apparatus 10. In an exemplary embodiment, the server 26 may include one or more host computers, the computer 40 of the apparatus 10, and/or one or more computers in one or more other apparatuses that are substantially similar to the apparatus 10.

In an exemplary embodiment, the apparatus 10 may be characterized as a thick client. In an exemplary embodiment, the apparatus 10 may be characterized as a thin client, and therefore the functions and/or uses of the computer 40 including the processor 42 and/or the memory 44 may instead be functions and/or uses of the server 26. In several exemplary embodiments, the apparatus 10 may function as both a thin client and a thick client, with the degree to which the apparatus 10 functions as a thin client and/or a thick client being dependent upon a variety of factors including, but not limited to, the instructions stored in the memory 44 for execution by the processor 42.

Figure 17:
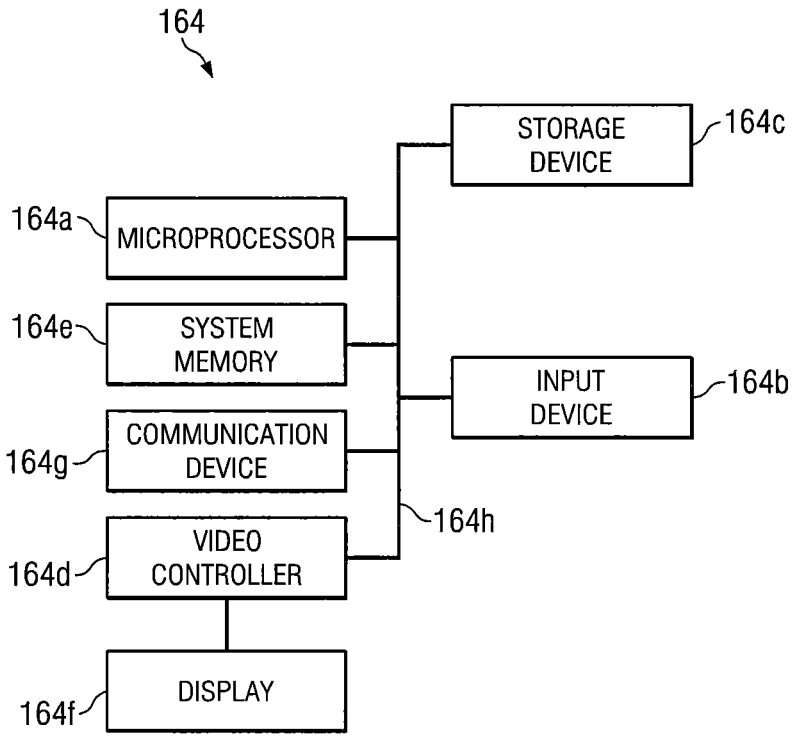
FIG. 17 is a diagrammatic illustration of a node for implementing one or more exemplary embodiments of the present disclosure, according to an exemplary embodiment.

In an exemplary embodiment, as illustrated in FIG. 17 with continuing reference to FIGS. 1-16B, an illustrative node 164 for implementing one or more embodiments of one or more of the above-described networks, elements, methods and/or steps, and/or any combination thereof, is depicted. The node 164 includes a microprocessor 164*a*, an input device 164*b*, a storage device 164*c*, a video controller 164*d*, a system memory 164*e*, a display 164*f*, and a communication device 164*g* all interconnected by one or more buses 164*h*. In several exemplary embodiments, the storage device 164*c* may include a floppy drive, hard drive, CD-ROM, optical drive, any other form of storage device and/or any combination thereof. In several exemplary embodiments, the storage device 164*c* may include, and/or be capable of receiving, a floppy disk, CD-ROM, DVD-ROM, or any other form of computer-readable medium that may contain executable instructions. In several exemplary embodiments, the communication device 164*g* may include a modem, network card, or any other device to enable the node to communicate with other nodes. In several exemplary embodiments, any node represents a plurality of interconnected (whether by intranet or Internet) computer systems, including without limitation, personal computers, mainframes, PDAs, and cell phones.

In several exemplary embodiments, one or more of the central server 26, the network 28, the remote user devices 30*a* and 30*b*, the control system 38, the computer 40, the control panel 18, the communication module 46, the sensors 48*a*, 48*b*, 48*c* and 48*d*, any other of the above-described sensors, and/or any of the above-described motors is, or at least includes, the node 164 and/or components thereof, and/or one or more nodes that are substantially similar to the node 164 and/or components thereof.

In several exemplary embodiments, a computer system typically includes at least hardware capable of executing machine readable instructions, as well as the software for executing acts (typically machine-readable instructions) that produce a desired result. In several exemplary embodiments, a computer system may include hybrids of hardware and software, as well as computer sub-systems.

In several exemplary embodiments, hardware generally includes at least processor-capable platforms, such as client-machines (also known as personal computers or servers), and hand-held processing devices (such as smart phones, personal digital assistants (PDAs), or personal computing devices (PCDs), for example). In several exemplary embodiments, hardware may include any physical device that is capable of storing machine-readable instructions, such as memory or other data storage devices. In several exemplary embodiments, other forms of hardware include hardware sub-systems, including transfer devices such as modems, modem cards, ports, and port cards, for example.

In several exemplary embodiments, software includes any machine code stored in any memory medium, such as RAM or ROM, and machine code stored on other devices (such as floppy disks, flash memory, or a CD ROM, for example). In several exemplary embodiments, software may include source or object code. In several exemplary embodiments, software encompasses any set of instructions capable of being executed on a node such as, for example, on a client machine or server.

In several exemplary embodiments, combinations of software and hardware could also be used for providing enhanced functionality and performance for certain embodiments of the present disclosure. In an exemplary embodiment, software functions may be directly manufactured into a silicon chip. Accordingly, it should be understood that combinations of hardware and software are also included within the definition of a computer system and are thus envisioned by the present disclosure as possible equivalent structures and equivalent methods.

In several exemplary embodiments, computer readable mediums include, for example, passive data storage, such as a random access memory (RAM) as well as semi-permanent data storage such as a compact disk read only memory (CD-ROM). One or more exemplary embodiments of the present disclosure may be embodied in the RAM of a computer to transform a standard computer into a new specific computing machine. In several exemplary embodiments, data structures are defined organizations of data that may enable an embodiment of the present disclosure. In an exemplary embodiment, a data structure may provide an organization of data, or an organization of executable code. In several exemplary embodiments, data signals could be carried across transmission mediums and store and transport various data structures, and, thus, may be used to transport an embodiment of the present disclosure.

In several exemplary embodiments, the network 28, and/or one or more portions thereof, may be designed to work on any specific architecture. In an exemplary embodiment, one or more portions of the network 28 may be executed on a single computer, local area networks, client-server networks, wide area networks, internets, hand-held and other portable and wireless devices and networks.

In several exemplary embodiments, a database may be any standard or proprietary database software, such as Oracle, Microsoft Access, SyBase, or DBase II, for example. In several exemplary embodiments, the database may have fields, records, data, and other database elements that may be associated through database specific software. In several exemplary embodiments, data may be mapped. In several exemplary embodiments, mapping is the process of associating one data entry with another data entry. In an exemplary embodiment, the data contained in the location of a character file can be mapped to a field in a second table. In several exemplary embodiments, the physical location of the database is not limiting, and the database may be distributed. In an exemplary embodiment, the database may exist remotely from the server, and run on a separate platform. In an exemplary embodiment, the database may be accessible across the Internet. In several exemplary embodiments, more than one database may be implemented.

In several exemplary embodiments, while different steps, processes, and procedures are described as appearing as distinct acts, one or more of the steps, one or more of the processes, and/or one or more of the procedures could also be performed in different orders, simultaneously and/or sequentially. In several exemplary embodiments, the steps, processes and/or procedures could be merged into one or more steps, processes and/or procedures.

A method has been described that includes automatically disposing measured amounts of ice in respective bags provided from a first source of bags; determining whether an event has occurred; and if the event has occurred, then automatically disposing measured amounts of ice in respective bags provided from a second source of bags in response to the determination of the occurrence of the event. In an exemplary embodiment, the event is selected from the group consisting of: all of the bags from the first source of bags having been used; a predetermined number of bags from the first source of bags having been used; and an inability to further automatically dispose measured amounts of ice in respective bags provided from the first source of bags. In an exemplary embodiment, automatically disposing measured amounts of ice in respective bags provided from the first source of bags comprises engaging a first roller with a bag from the first source of bags; driving the first roller to feed the bag from the first source of bags; and disposing a measured amount of ice in the bag from the first source of bags. In an exemplary embodiment, automatically disposing measured amounts of ice in respective bags provided from the second source of bags comprises engaging a second roller with an initial bag from the second source of bags; driving the second roller to feed the initial bag from the second source of bags; driving the first roller to further feed the initial bag from the second source of bags; and disposing a measured amount of ice in the initial bag from the second source of bags. In an exemplary embodiment, automatically disposing measured amounts of ice in respective bags provided from the second source of bags further comprises before driving the second roller to feed the initial bag from the second source of bags, engaging a third roller with the initial bag from the second source of bags so that the initial bag from the second source of bags is held in place between the second and third rollers; and during or after driving the second roller to feed the initial bag from the second source of bags, disengaging the third roller from either the initial bag from the second source of bags or a remaining bag from the second source of bags. In an exemplary embodiment, the event is all of the bags from the first source of bags having been used; wherein determining whether the event has occurred comprises sensing the presence or absence of one or more remaining bags from the first source of bags after driving the first roller to feed the bag from the first source of bags; and wherein the occurrence of the event is determined when, after driving the first roller to feed the bag from the first source of bags, the absence of the one or more remaining bags from the first source of bags is sensed. In an exemplary embodiment, the first source of bags is a first roll of bags; wherein the second source of bags is a second roll of bags; wherein automatically disposing measured amounts of ice in respective bags provided from the first source of bags comprises engaging between a first pair of rollers a bag from the first source of bags; driving at least one roller in the first pair of rollers to thereby feed to a bag basket the bag from the first source of bags; and when the bag from the first source of bags is at least partially disposed in the bag basket, disposing a measured amount of ice in the bag from the first source of bags; and wherein automatically disposing measured amounts of ice in respective bags provided from the first source of bags comprises engaging between a second pair of rollers an initial bag from the second source of bags to thereby hold the initial bag from the second source of bags in place; driving one of the rollers in the second pair of rollers to thereby feed to the first pair of rollers the initial bag from the second source of bags; driving the at least one roller in the first pair of rollers to thereby feed to the bag basket the initial bag from the second source of bags; when the initial bag from the second source of bags is at least partially disposed in the bag basket, disposing a measured amount of ice in the initial bag from the second source of bags; and spacing the other of the rollers in the second pair of rollers away from the one of the rollers in the second pair of rollers during or after driving the one of the rollers in the second pair of rollers. In an exemplary embodiment, the method includes making the ice; measuring the respective amounts of ice; and storing in a temperature-controlled storage unit the bags in which the respective measured amounts of ice are disposed. In an exemplary embodiment, the method includes distributing within the temperature-controlled storage unit the bags in which the respective measured amounts of ice are disposed.

An apparatus has been described that includes a first source of bags, each of the bags from the first source of bags being adapted to be filled with ice; a second source of bags, each the bags from the second source of bags being adapted to be filled with ice; a first bag advance assembly configured to be operably coupled to either the first source of bags or the second source of bags; and a second bag advance assembly configured to be operably coupled to the second source of bags. In an exemplary embodiment, the first bag advance assembly comprises a first roller; and a first motor adapted to drive the first roller; and wherein the second bag advance assembly comprises second and third rollers; and a second motor adapted to drive the second roller. In an exemplary embodiment, the apparatus includes a first configuration in which the first roller of the first bag advance assembly is engaged with a bag from the first source of bags so that, when the first motor drives the first roller, the first bag advance assembly feeds the bag from the first source of bags; and an initial bag from the second source of bags is engaged with, and held in place between, the second and third rollers. In an exemplary embodiment, the apparatus includes a second configuration in which the first roller of the first bag advance assembly is not engaged with any bag from the first source of bags; the initial bag from the second source of bags is engaged with the second and third rollers so that, when the second motor drives the second roller, the second bag advance assembly feeds the initial bag from the second source of bags to the first bag advance assembly. In an exemplary embodiment, the apparatus includes a third configuration in which the first roller of the first bag assembly is engaged with the initial bag from the second source of bags so that, when the first motor drives the first roller, the first bag advance assembly feeds the initial bag from the second source of bags. In an exemplary embodiment, the apparatus includes a support frame to which the third roller is coupled; a pivot element about which the support frame and thus the third roller are adapted to pivot; a solenoid actuator comprising an actuator rod; wherein the actuator rod engages the support frame when the solenoid actuator is energized. In an exemplary embodiment, the apparatus includes a first spring coupled to the support frame and configured to urge the support frame to pivot in a first direction; a spring clip adapted to engage the support frame to thereby resist the pivoting of the support frame in the first direction; and a second spring coupled to the spring clip and configured to urge the spring clip to pivot, relative to the support frame. In an exemplary embodiment, when the solenoid actuator has not yet been energized: the actuator rod does not engage the support frame; and the spring clip engages the support frame and thereby resists the pivoting of the support frame in the first direction. In an exemplary embodiment, when the solenoid actuator is energized: the actuator rod engages the support frame and thereby urges the support frame to pivot in a second direction, the second direction being opposite to the first direction; and the spring clip does not engage the support frame; and the spring clip is permitted to pivot, relative to the support frame, in response to the urging of the second spring. In an exemplary embodiment, when the solenoid actuator is de-energized: the actuator rod does not engage the support frame; the spring clip does not engage the support frame; and the support frame is permitted to pivot in the first direction, in response to the urging of the first spring. In an exemplary embodiment, the first bag advance assembly comprises a first roller; and a first motor adapted to drive the first roller; wherein the second bag advance assembly comprises second and third rollers; and a second motor adapted to drive the second roller; and wherein the apparatus further comprises a support frame to which the third roller is coupled; a pivot element about which the support frame and thus the third roller are adapted to pivot; a solenoid actuator comprising an actuator rod, wherein the actuator rod engages the support frame when the solenoid actuator is energized; a first spring coupled to the support frame and configured to urge the support frame to pivot in a first direction; a spring clip adapted to engage the support frame to thereby resist the pivoting of the support frame in the first direction; and a second spring coupled to the spring clip and configured to urge the spring clip to pivot, relative to the support frame; a first configuration in which: the solenoid actuator is not energized; the actuator rod does not engage the support frame; the first roller of the first bag advance assembly is engaged with a bag from the first source of bags so that, when the first motor drives the first roller, the first bag advance assembly feeds the bag from the first source of bags; an initial bag from the second source of bags is engaged with, and held in place between, the second and third rollers; and the spring clip engages the support frame and thereby resists the pivoting of the support frame in the first direction, thereby maintaining the engagement of the initial bag from the second source of bags with the second and third rollers; a second configuration in which: the first roller of the first bag advance assembly is not engaged with any bag from the first source of bags; the solenoid actuator is energized and thus the actuator rod engages the support frame and thereby urges the support frame to pivot in a second direction, the second direction being opposite to the first direction; the initial bag from the second source of bags is engaged with the second and third rollers so that, when the second motor drives the second roller, the second bag advance assembly feeds the initial bag from the second source of bags to the first bag advance assembly; and the spring clip does not engage the support frame and thus the spring clip is permitted to pivot, relative to the support frame, in response to the urging of the second spring; and a third configuration in which the solenoid actuator is not energized; the actuator rod does not engage the support frame; the spring clip does not engage the support frame; and the first roller of the first bag assembly is engaged with the initial bag from the second source of bags so that, when the first motor drives the first roller, the first bag advance assembly feeds the initial bag from the second source of bags. In an exemplary embodiment, the apparatus includes at least one ice maker; a hopper in which ice made by the at least one ice maker is adapted to be disposed, wherein the respective bags are configured to be filled with ice previously disposed in the hopper; and a temperature-controlled storage unit configured to store the respective ice-filled bags.

A system has been described that includes means for automatically disposing measured amounts of ice in respective bags provided from a first source of bags; means for determining whether an event has occurred; and means for if the event has occurred, then automatically disposing measured amounts of ice in respective bags provided from a second source of bags in response to the determination of the occurrence of the event. In an exemplary embodiment, the event is selected from the group consisting of: all of the bags from the first source of bags having been used; a predetermined number of bags from the first source of bags having been used; and an inability to further automatically dispose measured amounts of ice in respective bags provided from the first source of bags. In an exemplary embodiment, means for automatically disposing measured amounts of ice in respective bags provided from the first source of bags comprises means for engaging a first roller with a bag from the first source of bags; means for driving the first roller to feed the bag from the first source of bags; and means for disposing a measured amount of ice in the bag from the first source of bags. In an exemplary embodiment, means for automatically disposing measured amounts of ice in respective bags provided from the second source of bags comprises means for engaging a second roller with an initial bag from the second source of bags; means for driving the second roller to feed the initial bag from the second source of bags; means for driving the first roller to further feed the initial bag from the second source of bags; and means for disposing a measured amount of ice in the initial bag from the second source of bags. In an exemplary embodiment, means for automatically disposing measured amounts of ice in respective bags provided from the second source of bags further comprises means for before driving the second roller to feed the initial bag from the second source of bags, engaging a third roller with the initial bag from the second source of bags so that the initial bag from the second source of bags is held in place between the second and third rollers; and means for during or after driving the second roller to feed the initial bag from the second source of bags, disengaging the third roller from either the initial bag from the second source of bags or a remaining bag from the second source of bags. In an exemplary embodiment, the event is all of the bags from the first source of bags having been used; wherein means for determining whether the event has occurred comprises means for sensing the presence or absence of one or more remaining bags from the first source of bags after driving the first roller to feed the bag from the first source of bags; and wherein the occurrence of the event is determined when, after driving the first roller to feed the bag from the first source of bags, the absence of the one or more remaining bags from the first source of bags is sensed. In an exemplary embodiment, the first source of bags is a first roll of bags; wherein the second source of bags is a second roll of bags; wherein means for automatically disposing measured amounts of ice in respective bags provided from the first source of bags comprises means for engaging between a first pair of rollers a bag from the first source of bags; means for driving at least one roller in the first pair of rollers to thereby feed to a bag basket the bag from the first source of bags; and means for when the bag from the first source of bags is at least partially disposed in the bag basket, disposing a measured amount of ice in the bag from the first source of bags; and wherein means for automatically disposing measured amounts of ice in respective bags provided from the first source of bags comprises means for engaging between a second pair of rollers an initial bag from the second source of bags to thereby hold the initial bag from the second source of bags in place; means for driving one of the rollers in the second pair of rollers to thereby feed to the first pair of rollers the initial bag from the second source of bags; means for driving the at least one roller in the first pair of rollers to thereby feed to the bag basket the initial bag from the second source of bags; means for when the initial bag from the second source of bags is at least partially disposed in the bag basket, disposing a measured amount of ice in the initial bag from the second source of bags; and means for spacing the other of the rollers in the second pair of rollers away from the one of the rollers in the second pair of rollers during or after driving the one of the rollers in the second pair of rollers. In an exemplary embodiment, the system includes means for making the ice; means for measuring the respective amounts of ice; and means for storing in a temperature-controlled storage unit the bags in which the respective measured amounts of ice are disposed. In an exemplary embodiment, the system includes means for distributing within the temperature-controlled storage unit the bags in which the respective measured amounts of ice are disposed.

A computer readable medium has been described that includes a plurality of instructions stored therein, the plurality of instructions including instructions for automatically disposing measured amounts of ice in respective bags provided from a first source of bags; instructions for determining whether an event has occurred; and instructions for if the event has occurred, then automatically disposing measured amounts of ice in respective bags provided from a second source of bags in response to the determination of the occurrence of the event. In an exemplary embodiment, the event is selected from the group consisting of: all of the bags from the first source of bags having been used; a predetermined number of bags from the first source of bags having been used; and an inability to further automatically dispose measured amounts of ice in respective bags provided from the first source of bags. In an exemplary embodiment, instructions for automatically disposing measured amounts of ice in respective bags provided from the first source of bags comprise instructions for engaging a first roller with a bag from the first source of bags; instructions for driving the first roller to feed the bag from the first source of bags; and instructions for disposing a measured amount of ice in the bag from the first source of bags. In an exemplary embodiment, instructions for automatically disposing measured amounts of ice in respective bags provided from the second source of bags comprise instructions for engaging a second roller with an initial bag from the second source of bags; instructions for driving the second roller to feed the initial bag from the second source of bags; instructions for driving the first roller to further feed the initial bag from the second source of bags; and instructions for disposing a measured amount of ice in the initial bag from the second source of bags. In an exemplary embodiment, instructions for automatically disposing measured amounts of ice in respective bags provided from the second source of bags further comprise instructions for before driving the second roller to feed the initial bag from the second source of bags, engaging a third roller with the initial bag from the second source of bags so that the initial bag from the second source of bags is held in place between the second and third rollers; and instructions for during or after driving the second roller to feed the initial bag from the second source of bags, disengaging the third roller from either the initial bag from the second source of bags or a remaining bag from the second source of bags. In an exemplary embodiment, the event is all of the bags from the first source of bags having been used; wherein instructions for determining whether the event has occurred comprises instructions for sensing the presence or absence of one or more remaining bags from the first source of bags after driving the first roller to feed the bag from the first source of bags; and wherein the occurrence of the event is determined when, after driving the first roller to feed the bag from the first source of bags, the absence of the one or more remaining bags from the first source of bags is sensed. In an exemplary embodiment, instructions for automatically disposing measured amounts of ice in respective bags provided from the first source of bags comprise instructions for engaging between a first pair of rollers a bag from the first source of bags; instructions for driving at least one roller in the first pair of rollers to thereby feed to a bag basket the bag from the first source of bags; and instructions for when the bag from the first source of bags is at least partially disposed in the bag basket, disposing a measured amount of ice in the bag from the first source of bags; and wherein instructions for automatically disposing measured amounts of ice in respective bags provided from the first source of bags comprise instructions for engaging between a second pair of rollers an initial bag from the second source of bags to thereby hold the initial bag from the second source of bags in place; instructions for driving one of the rollers in the second pair of rollers to thereby feed to the first pair of rollers the initial bag from the second source of bags; instructions for driving the at least one roller in the first pair of rollers to thereby feed to the bag basket the initial bag from the second source of bags; instructions for when the initial bag from the second source of bags is at least partially disposed in the bag basket, disposing a measured amount of ice in the initial bag from the second source of bags; and instructions for spacing the other of the rollers in the second pair of rollers away from the one of the rollers in the second pair of rollers during or after driving the one of the rollers in the second pair of rollers. In an exemplary embodiment, the plurality of instructions further comprises instructions for making the ice; instructions for measuring the respective amounts of ice; and instructions for storing in a temperature-controlled storage unit the bags in which the respective measured amounts of ice are disposed. In an exemplary embodiment, the plurality of instructions further comprises instructions for distributing within the temperature-controlled storage unit the bags in which the respective measured amounts of ice are disposed.

It is understood that variations may be made in the foregoing without departing from the scope of the disclosure. Furthermore, the elements and teachings of the various illustrative exemplary embodiments may be combined in whole or in part in some or all of the illustrative exemplary embodiments. In addition, one or more of the elements and teachings of the various illustrative exemplary embodiments may be omitted, at least in part, and/or combined, at least in part, with one or more of the other elements and teachings of the various illustrative embodiments.

Any spatial references such as, for example, "upper," "lower," "above," "below," "between," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several exemplary embodiments have been described in detail above, the embodiments described are exemplary only and are not limiting, and those skilled in the art will readily appreciate that many other modifications, changes and/or substitutions are possible in the exemplary embodiments without materially departing from the novel teachings and advantages of the present disclosure. Accordingly, all such modifications, changes and/or substitutions are intended to be included within the scope of this disclosure as defined in the following claims. In the claims, means-plus-function clauses are intended to cover the structures described herein as performing the recited function and not only structural equivalents, but also equivalent structures.

What is claimed is:

1. An apparatus, comprising:

first and second sources of bags, each of the bags from the first source of bags being adapted to be filled with ice and being non-contiguous with each of the bags from the second source of bags, and each of the bags from the second source of bags being adapted to be filled with ice and being non-contiguous with each of the bags from the first source of bags;

a first bag advance assembly configured to be operably coupled to either the first source of bags or the second source of bags; and a second bag advance assembly comprising a first roller and being configured to be operably coupled to the second source of bags;

wherein the apparatus is actuable between:

a first configuration in which:

the first bag advance assembly is operably coupled to the first source of bags so that the first source of bags is configured to rotate in place about a first longitudinal axis; and the first bag advance assembly is not operably coupled to the second source of bags;

a second configuration in which:

the first bag advance assembly is not operably coupled to the first source of bags; and the second bag advance assembly is operably coupled to the second source of bags so that the second source of bags is configured to rotate in place about a second longitudinal axis;

and a third configuration in which:

the first bag advance assembly is operably coupled to the second source of bags so that the second source of bags is configured to rotate in place about the second longitudinal axis; and the first roller of the second bag advance assembly is not engaged with any bag from the second source of bags.

2. The apparatus of claim 1, wherein the first bag advance assembly comprises:

a second roller; and a first motor adapted to drive the second roller.

3. The apparatus of claim 2, wherein, when the apparatus is in the first configuration:

the second roller is engaged with a bag from the first source of bags so that, when the first motor drives the second roller, the first bag advance assembly feeds the bag from the first source of bags; and the second roller is not engaged with any bag from the second source of bags.

4. The apparatus of claim 3, wherein, when the apparatus is in the second configuration:

the second roller is not engaged with any bag from the first source of bags;

and the first roller is engaged with a bag from the second source of bags so that the second bag advance assembly is adapted to feed the bag from the second source of bags.

5. The apparatus of claim 1, further comprising:

at least one ice maker;

a hopper in which ice made by the at least one ice maker is adapted to be disposed, wherein the respective bags are configured to be filled with ice previously disposed in the hopper; and a temperature-controlled storage unit configured to store the respective ice-filled bags.

6. A method, comprising:

providing first and second sources of bags, each of the bags from the first source of bags being adapted to be filled with ice and being non-contiguous with each of the bags from the second source of bags, and each of the bags from the second source of bags being adapted to be filled with ice and being non-contiguous with each of the bags from the first source of bags;

operably coupling the first source of bags to a first bag advance assembly so that the first bag advance assembly is adapted to feed bags from the first source of bags and the first source of bags is configured to rotate in place about a first longitudinal axis;

operably coupling the second source of bags to a second bag advance assembly comprising a first roller so that the second bag advance assembly is adapted to feed bags from the second source of bags and the second source of bags is configured to rotate in place about a second longitudinal axis; and operably coupling, using the second bag advance assembly, the second source of bags to the first bag advance assembly so that the first bag advance assembly is adapted to feed the bags from the second source of bags and the second source of bags is configured to rotate in place about the second longitudinal axis;

wherein operably coupling, using the second bag advance assembly, the second source of bags to the first bag advance assembly comprises:

feeding, using the first roller, the bags from the second source of bags into the first bag advance assembly; and disengaging the first roller from the second source of bags.

7. The method of claim 6, further comprising:

using the first bag advance assembly to feed a bag from the first source of bags;

using the second bag advance assembly to feed a bag from the second source of bags into the first bag advance assembly; and using the first bag advance assembly to feed the bag from the second source of bags;

wherein the bag from the second source of bags is fed after the bag from the first source of bags has been fed.

8. The method of claim 7, wherein the first bag advance assembly comprises:

a second roller; and a first motor adapted to drive the second roller.

9. The method of claim 8, wherein using the first bag advance assembly to feed the bag from the first source of bags comprises:

engaging the second roller with the bag from the first source of bags; and using the first motor to drive the second roller to feed the bag from the first source of bags;

wherein using the second bag advance assembly to feed the bag from the second source of bags into the first bag advance assembly comprises:

engaging the first roller with the bag from the second source of bags;

and wherein using the first bag advance assembly to feed the bag from the second source of bags comprises:

engaging the first second roller with the bag from the second source of bags; and using the first motor to drive the second roller to feed the bag from the second source of bags.

10. The method of claim 9, further comprising:

using at least one ice maker to make ice;

disposing in a hopper the ice made by the at least one ice maker;

filling the bag from the first source of bags with a first amount of the ice made by the at least one ice maker and previously disposed in the hopper;

storing the ice-filled bag from the first source of bags in a temperature-controlled storage unit;

filling the bag from the second source of bags with a second amount of the ice made by the at least one ice maker and previously disposed in the hopper; and storing the ice-filled bag from the second source of bags in the temperature-controlled storage unit.

11. The method of claim 6, further comprising:

using at least one ice maker to make ice;

disposing in a hopper the ice made by the at least one ice maker;

filling a bag from the first source of bags with a first amount of the ice made by the at least one ice maker and previously disposed in the hopper;

storing the ice-filled bag from the first source of bags in a temperature-controlled storage unit;

filling a bag from the second source of bags with a second amount of the ice made by the at least one ice maker and previously disposed in the hopper; and storing the ice-filled bag from the second source of bags in the temperature-controlled storage unit.

12. An apparatus, comprising:

a first source of bags, each of the bags from the first source of bags being adapted to be filled with ice;

a second source of bags, each of the bags from the second source of bags being adapted to be filled with ice;

a first bag advance assembly configured to be operably coupled to either the first source of bags or the second source of bags; and a second bag advance assembly configured to be operably coupled to the second source of bags;

wherein the apparatus is actuable between:

a first configuration in which:

the first bag advance assembly is operably coupled to the first source of bags so that the first source of bags is configured to rotate in place about a first longitudinal axis; and the first bag advance assembly is not operably coupled to the second source of bags;

a second configuration in which:

the first bag advance assembly is not operably coupled to the first source of bags; and the second bag advance assembly is operably coupled to the second source of bags so that the second source of bags is configured to rotate in place about a second longitudinal axis;

and a third configuration in which:

the first bag advance assembly is operably coupled to the second source of bags so that the second source of bags is configured to rotate in place about the second longitudinal axis;

wherein the second bag advance assembly comprises a first roller;

wherein, when the apparatus is in the second configuration:

the first roller is engaged with a bag from the second source of bags; and wherein, when the apparatus is in the third configuration:

the first roller is not engaged with any bag from the second source of bags.

13. The apparatus of claim 12, wherein the first bag advance assembly comprises a second roller and a motor adapted to drive the second roller;

wherein, when the apparatus is in the first configuration:

the second roller is engaged with a bag from the first source of bags so that, when the motor drives the second roller, the first bag advance assembly feeds the bag from the first source of bags; and the second roller is not engaged with any bag from the second source of bags;

and wherein, when the apparatus is in the third configuration:

the second roller is not engaged with any bag from the first source of bags; and the second roller is engaged with a bag from the second source of bags so that, when the motor drives the second roller, the first bag advance assembly feeds the bag from the second source of bags.

14. The apparatus of claim 12, further comprising:

at least one ice maker;

a hopper in which ice made by the at least one ice maker is adapted to be disposed, wherein the respective bags are configured to be filled with ice previously disposed in the hopper; and a temperature-controlled storage unit configured to store the respective ice-filled bags.

15. The apparatus of claim 12, wherein the first bag advance assembly comprises a second roller and a first motor adapted to drive the second roller;

wherein, when the apparatus is in the first configuration:

the second roller is engaged with a bag from the first source of bags so that, when the first motor drives the second roller, the first bag advance assembly feeds the bag from the first source of bags; and the second roller is not engaged with any bag from the second source of bags;

wherein, when the apparatus is in the second configuration:

the second roller is not engaged with any bag from the first source of bags;

and wherein, when the apparatus is in the third configuration:

the second roller is engaged with the bag from the second source of bags so that, when the first motor drives the second roller, the first bag advance assembly feeds the bag from the second source of bags.

16. An apparatus, comprising:

first and second sources of bags, each of the bags from the first source of bags being adapted to be filled with ice and being non-contiguous with each of the bags from the second source of bags, and each of the bags from the second source of bags being adapted to be filled with ice and being non-contiguous with each of the bags from the first source of bags;

a first bag advance assembly configured to be operably coupled to either the first source of bags or the second source of bags; and a second bag advance assembly configured to be operably coupled to the second source of bags;

wherein the apparatus is actuable between:

a first configuration in which:

the first bag advance assembly is operably coupled to the first source of bags so that the first source of bags is configured to rotate in place about a first longitudinal axis; and the first bag advance assembly is not operably coupled to the second source of bags;

a second configuration in which:

the first bag advance assembly is not operably coupled to the first source of bags; and the second bag advance assembly is operably coupled to the second source of bags so that the second source of bags is configured to rotate in place about a second longitudinal axis;

and a third configuration in which:

the first bag advance assembly is operably coupled to the second source of bags so that the second source of bags is configured to rotate in place about the second longitudinal axis;

wherein the first bag advance assembly comprises:

a first roller; and a first motor adapted to drive the first roller;

wherein the second bag advance assembly comprises a second roller;

wherein, when the apparatus is in the first configuration:

the first roller is engaged with a bag from the first source of bags so that, when the first motor drives the first roller, the first bag advance assembly feeds the bag from the first source of bags; and the first roller is not engaged with any bag from the second source of bags;

wherein, when the apparatus is in the second configuration:

the first roller is not engaged with any bag from the first source of bags; and the second roller is engaged with a bag from the second source of bags so that the second bag advance assembly is adapted to feed the bag from the second source of bags;

and wherein, when the apparatus is in the third configuration:

the first roller is engaged with the bag from the second source of bags so that, when the first motor drives the first roller, the first bag advance assembly feeds the bag from the second source of bags; and the second roller is not engaged with any bag from the second source of bags.

17. The apparatus of claim 16, further comprising:

at least one ice maker;

a hopper in which ice made by the at least one ice maker is adapted to be disposed, wherein the respective bags are configured to be filled with ice previously disposed in the hopper; and a temperature-controlled storage unit configured to store the respective ice-filled bags.

* * * * *